US012157861B2

(12) United States Patent
Peer Lachegurabi et al.

(10) Patent No.: US 12,157,861 B2
(45) Date of Patent: Dec. 3, 2024

(54) FLUID FOR TAR HYDROPROCESSING

(71) Applicant: ExxonMobil Chemical Patents Inc., Baytown, TX (US)

(72) Inventors: Maryam Peer Lachegurabi, Bridgewater, NJ (US); Krystle J. Emanuele, Hummelstown, PA (US); Kapil Kandel, Humble, TX (US); Frank Cheng-Yu Wang, Annandale, NJ (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 122 days.

(21) Appl. No.: 17/998,033

(22) PCT Filed: May 5, 2021

(86) PCT No.: PCT/US2021/030829

§ 371 (c)(1),
(2) Date: Nov. 5, 2022

(87) PCT Pub. No.: WO2021/236326

PCT Pub. Date: Nov. 25, 2021

(65) Prior Publication Data

US 2023/0174876 A1 Jun. 8, 2023

Related U.S. Application Data

(60) Provisional application No. 63/029,084, filed on May 22, 2020.

(51) Int. Cl.
*C10G 35/04* (2006.01)
*C10G 49/22* (2006.01)
(Continued)

(52) U.S. Cl.
CPC ..... *C10G 65/02* (2013.01); *C10G 35/04* (2013.01); *C10G 49/22* (2013.01); *C10G 49/24* (2013.01);
(Continued)

(58) Field of Classification Search
CPC ..... C10G 2300/202; C10G 2300/301; C10G 2300/308; C10G 2300/4031;
(Continued)

(56) References Cited

U.S. PATENT DOCUMENTS 2,382,260 A 8/1945 Schaad ..... 260/671
5,158,668 A 10/1992 Chahar et al. ..... 208/50
(Continued)

FOREIGN PATENT DOCUMENTS

WO WO2013/033590 3/2013 ..... C10G 69/06
WO WO2015/167774 11/2015
(Continued)

*Primary Examiner* — Ellen M McAvoy
*Assistant Examiner* — Chantel Graham

(57) ABSTRACT

Hydrocarbon-containing fluids are provided for use during solvent-assisted hydroprocessing of pyrolysis tar, such as steam cracker tar. The hydrocarbon-containing fluids can be used at any convenient time, such as during start-up of a pyrolysis process when recycled liquid pyrolysis product is not available; when the amount of liquid pyrolysis product available for recycle is not sufficient to maintain desired hydroprocessing conditions; and/or when the changes to the quality of the liquid pyrolysis product reduce the suitability of the recycle stream for use as a utility fluid.

26 Claims, 5 Drawing Sheets

(51) Int. Cl.

| | |
|---|---|
| ***C10G 49/24*** | (2006.01) |
| ***C10G 65/02*** | (2006.01) |
| ***C10G 69/06*** | (2006.01) |
| ***C10G 69/08*** | (2006.01) |

(52) U.S. Cl.
CPC ..... *C10G 69/06* (2013.01); *C10G 69/08* (2013.01); *C10G 2300/202* (2013.01); *C10G 2300/301* (2013.01); *C10G 2300/308* (2013.01); *C10G 2300/4031* (2013.01); *C10G 2300/4081* (2013.01); *C10G 2300/44* (2013.01); *C10G 2300/802* (2013.01)

(58) Field of Classification Search
CPC ..... C10G 2300/4081; C10G 2300/44; C10G 2300/802; C10G 35/04; C10G 49/22; C10G 49/24; C10G 65/02; C10G 69/06; C10G 69/08; C10G 47/00; C10G 49/00; C10G 9/36
See application file for complete search history.

(56) References Cited

U.S. PATENT DOCUMENTS

| | | | | |
|---|---|---|---|---|
| 5,169,039 | A | 12/1992 | Kay et al. | 222/509 |
| 5,871,634 | A | 2/1999 | Wiehe et al. | 208/48 |
| 6,632,351 | B1 | 10/2003 | Ngan et al. | 208/132 |
| 7,090,765 | B2 | 8/2006 | Spicer et al. | 208/130 |
| 7,097,758 | B2 | 8/2006 | Stell et al. | 208/48 |
| 7,138,047 | B2 | 11/2006 | Stell et al. | 208/130 |
| 7,197,367 | B2 | 3/2007 | Brinkemper et al. | 700/90 |
| 7,220,887 | B2 | 5/2007 | Stell et al. | 585/647 |
| 7,235,705 | B2 | 6/2007 | Stell | 585/647 |
| 7,244,871 | B2 | 7/2007 | Stell et al. | 585/648 |
| 7,247,765 | B2 | 7/2007 | Stell et al. | 585/652 |
| 7,297,833 | B2 | 11/2007 | Beattie et al. | 585/652 |
| 7,311,746 | B2 | 12/2007 | Stell et al. | 55/419 |
| 7,312,371 | B2 | 12/2007 | Stell et al. | 585/652 |
| 7,351,872 | B2 | 4/2008 | Stell et al. | 585/652 |
| 7,488,459 | B2 | 2/2009 | Stell et al. | 422/198 |
| 7,578,929 | B2 | 8/2009 | Stell et al. | 208/130 |
| 7,820,035 | B2 | 10/2010 | McCoy et al. | 208/132 |
| 8,083,931 | B2 | 12/2011 | McCoy et al. | 208/67 |
| 9,090,836 | B2 | 7/2015 | Brown et al. | C10G 69/06 |
| 9,637,694 | B2 | 5/2017 | Evans et al. | C10G 69/06 |
| 9,777,227 | B2 | 10/2017 | Soultanidis et al. | C10G 49/00 |
| 9,809,756 | B2 | 11/2017 | Soultanidis et al. | C10C 1/205 |
| 10,597,592 | B2 | 3/2020 | Kandel et al. | C10G 69/06 |
| 2015/0361354 | A1 | 12/2015 | Xu et al. | C10G 31/10 |
| 2019/0367822 | A1 | 12/2019 | Kandel et al. | C10G 49/26 |
| 2020/0063046 | A1 | 2/2020 | Kandel et al. | C10G 69/06 |

FOREIGN PATENT DOCUMENTS

| | | | |
|---|---|---|---|
| WO | WO2018/111574 | 6/2018 | C10G 45/00 |
| WO | WO2018/111577 | 6/2018 | C10G 45/00 |
| WO | WO2020/046648 | 3/2020 | C10G 49/18 |

FLUID FOR TAR HYDROPROCESSING

CROSS-REFERENCE TO RELATED APPLICATIONS

This application is a US national phase application of PCT Application Serial No. PCT/US2021/030829 having a filing date of May 5, 2021, which claims priority to and the benefit of U.S. Provisional Application No. 63/029,084 having a filing date of May 22, 2020, the disclosures of which are incorporated herein by reference in their entireties.

FIELD

Systems and methods are provided for hydroprocessing tar in the presence of certain fluids.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is steam cracking, the pyrolysis tar is identified as steam-cracker tar, referred to as SCT. Hydroprocessing pyrolysis tar in the presence of a hydrogen-containing treat gas and at least one hydroprocessing catalyst produces an upgraded pyrolysis tar having improved blending characteristics with other heavy hydrocarbons such as fuel oil.

SCT generally contains relatively high molecular weight molecules, conventionally called Tar Heavies ("TH"). Catalytic hydroprocessing of undiluted SCT leads to significant catalyst deactivation. For example, a significant decrease in hydroprocessing efficiency is observed when hydroprocessing SCT at a temperature in the range of from 250° C. to 380° C., at a pressure in the range of 5400 kPa to 20,500 kPa, using (i) a treat gas containing molecular hydrogen and (ii) at least one catalyst containing one or more of Co, Ni, or Mo. The loss of efficiency has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

One option to lessen deposit formation is to hydroprocess the SCT in the presence of a utility fluid, e.g., a solvent having significant aromatics content. The upgraded SCT product generally has a decreased viscosity, decreased atmospheric boiling point range, and increased hydrogen content over that of the SCT feed, resulting in improved compatibility with fuel oil blend-stocks. Additionally, hydroprocessing the SCT in the presence of utility fluid produces fewer undesirable byproducts and the rate of increase in reactor pressure drop is lessened. Conventional processes for SCT hydroprocessing, disclosed in U.S. Pat. Nos. 2,382,260 and 5,158,668 and in International Patent Application Publication No. WO 2013/033590 involves recycling a portion of the hydroprocessed tar for use as the utility fluid.

An SCT feed can be combined with the utility fluid to form a tar-fluid mixture. The tar-fluid mixture is then hydroprocessed in at least one hydroprocessing. It is conventional to recycle a portion of the liquid phase components of the hydroprocessor effluent as utility fluid. When doing so, it has been found to be sometimes necessary to add a supplemental utility fluid (e.g., steam cracker naphtha) to the SCT feed and/or tar-fluid mixture to prevent deposits in the hydroprocessing reactor and/or pre-heating equipment. This can be the case when the quality of the SCT changes sufficiently to result in an increase in the viscosity and/or final boiling point of the liquid phase components of the hydroprocessed effluent.

Since the supplemental utility fluid is itself a valuable product of the steam cracking process, there is a need for a SCT hydroprocessing process having a decreased need for supplemental utility fluid. U.S. Pat. No. 9,777,227 describes examples of supplemental utility fluids that can be used when a recycled portion of liquid phase components is insufficient or not available.

It would be desirable to have additional and/or improved types of supplemental utility fluids. Preferably, the additional and/or improved types of supplemental utility fluids can correspond to disadvantaged and/or low value hydrocarbon-containing fluids. Optionally, the additional and/or improved supplemental utility fluid can correspond to a hydrocarbon-containing fluid that is lower in cost than conventional utility fluids. Optionally, use of the hydrocarbon-containing fluid as an additional and/or improved supplemental utility fluid can represent an upgrade in value relative to conventional uses for the hydrocarbon-containing fluid. Still another desirable feature would be to have a utility fluid that is readily available at the site of the steam cracker tar facility, such as a utility fluid at least partially formed from other hydrocarbons streams available at the site.

SUMMARY

In various aspects, methods, processes, and compositions are provided for tar hydroprocessing. The method includes combining (i) a tar feed and (ii) and a hydrocarbon-containing fluid. It has been found that certain hydrocarbon-containing fluids described herein can be used instead of or in addition to a conventional utility fluid and/or a conventional supplemental utility fluid to facilitate tar hydroprocessing. Like certain conventional utility fluids and certain conventional supplemental utility fluids, such hydrocarbon-containing fluids are sourced externally of the tar hydroprocessing process. Unlike those conventional fluids, however, the hydrocarbon-containing fluids of the invention have (i) one or more of a solubility blending number of 90 or more; a density of 0.98 g/cm$^3$ or less; and a bromine number of less than 5; and (ii) 30 wt. % or more of compounds with a ring class of 1.5 and/or 25 wt. % or less of compounds with a ring class of 2.5 or more. Conventional utility fluids such as those corresponding to a steady-state recycled portion of tar hydroprocessor effluent, can tend to have a lower content of compounds with a ring class of 1.5 and a greater content of compounds with a ring class of 2.5 or more.

The hydrocarbon-containing fluid is beneficial in that it can be produced by converting relatively low-value hydrocarbon in processes such as catalytic reforming. The hydrocarbon-containing fluid can facilitate tar hydroprocessing by introducing it into the process at various locations and at various times, e.g., as a primer fluid at start-up of tar hydroprocessing. The addition of the hydrocarbon-containing fluid can continue, e.g., until a sufficient amount and/or quality of recycle stream is available to use instead.

DETAILED DESCRIPTION

Figure 1:
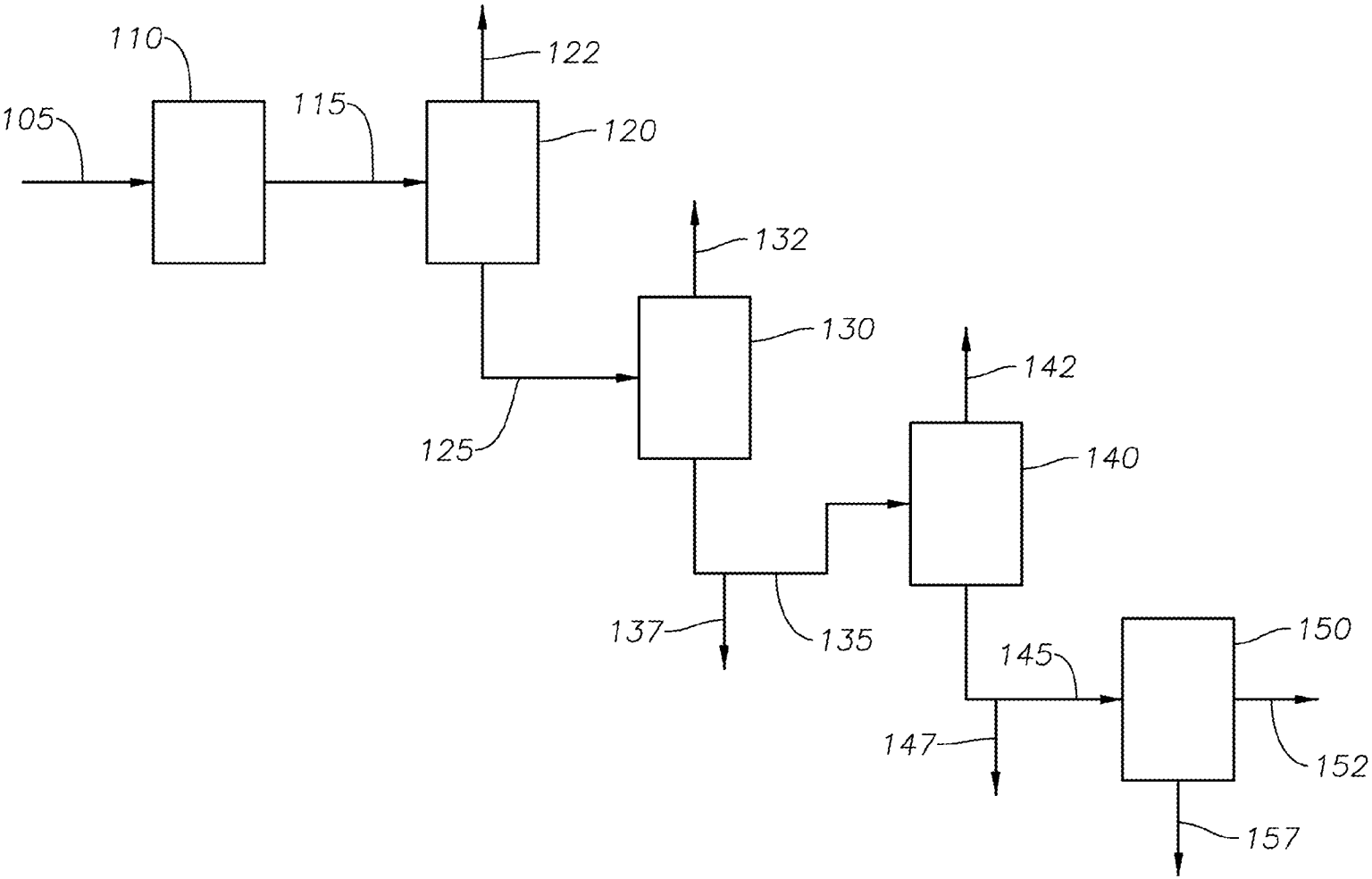
FIG. 1 shows an example of a process flow for performing catalytic reforming and separating various products from the reformed effluent.

In various aspects, a class of hydrocarbon-containing fluids are provided to facilitate tar hydroprocessing, e.g., pyrolysis tar hydroprocessing, such as steam cracker tar hydroprocessing.

A common way to perform tar hydroprocessing is to recycle a mid-cut portion of the hydroprocessor effluent for use as the utility fluid. For example, the recycled portion of the hydroprocessor effluent is typically a roughly 150° C. to 400° C. portion. While this can be effective during steady state operation, at start-up there will not be any hydroprocessor effluent available for use. Conventional utility fluid may similarly be unavailable and/or not available in sufficient amount at other times during processing, such as due to variations in tar quality.

When utility fluid based on a recycle stream is not available and/or only partially available, the specified hydrocarbon-containing fluid can be used to facilitate tar hydroprocessing until a sufficient amount of sufficient quality of the mid-cut portion of the hydroprocessor effluent are available again. The hydrocarbon-containing fluid has been found to have sufficient resistance to degradation under the hydroprocessing conditions. During pyrolysis tar hydroprocessing, the hydrocarbon-containing fluid thus substantially maintains a desirable compositional profile as a replacement utility fluid, such as maintaining a sufficiently large $S_{BN}$ for blending with a variety of tar feeds without appreciable asphaltene precipitation. Consequently, the hydrocarbon-containing fluid facilitates tar hydroprocessing at substantially the same hydroprocessing conditions as when using a recycled mid-cut effluent portion of the hydroprocessor effluent as the utility fluid.

It is noted that tar by itself typically contains few if any compounds (typically substantially none) having normal boiling points in a range of from 150° C. to 400° C. At the start of tar hydroprocessing, some conversion of the tar occurs to create compounds having a normal boiling points of ≤400° C., but the initial conversion tends to create a higher percentage of compounds in the mid-cut range with ring classes of 2.5 or more, or 3.0 or more. It has been discovered that at least in part as a result of its degradation resistance, using the specified hydrocarbon-containing fluid as a primer fluid (as a substitute for at least a portion of conventional supplemental utility fluid that would otherwise be used) decreases the amount of time for the mid-cut fraction to achieve the desired steady state composition for the mid-cut fraction, i.e., to achieve a composition corresponding to the desired utility fluid. This in turn leads to a greater $S_{BN}$ being maintained throughout the start-up period, as compared to when a conventional supplemental utility fluid is used as the primer fluid.

Maintaining a greater $S_{BN}$ can correlate with having a decreased or minimized amount of ring loss and/or ring saturation when exposed multiple times to the hydroprocessing conditions. Surprisingly it has been found that decreased ring loss and/or ring saturation can be achieved using the specified hydrocarbon-containing fluid since it has desirable blending characteristics (e.g., an appreciable $S_{BN}$) while also having an appreciable quantity of multi-ring compounds that include at least one non-aromatic ring. Without being bound by any particular theory, it is believed that the hydrocarbon-containing fluid's increased resistance to degradation under hydroprocessing conditions results at least in part from its high $S_{BN}$ and high number of multi-ring structures including non-aromatic rings, and that this in turn decreases the potential an $S_{BN}$ decrease as would otherwise result from aromatic saturation during pyrolysis tar hydroprocessing.

It has been discovered that various types of disadvantaged hydrocarbon-containing compositions can used to produce the specified hydrocarbon-containing fluid. For example, the specified hydrocarbon-containing fluid can be, include, or be derived from certain relatively low-value products of naphtha reforming. Such as hydrocarbon-containing fluid can comprise comprising ≥30 wt. % of compounds with a ring class of 1.5 and ≤20 wt. % of compounds with a ring class of 1.0, based on the weight of the hydrocarbon-containing fluid, wherein the hydrocarbon-containing fluid has a $S_{BN} \geq 90$, a density ≤0.98 g/cm$^3$, and a bromine number <5.

In certain aspects, naphtha is separated from a hydrocarbon feed comprising one or more crude oils. Typically, at least a portion of the naphtha is reformed in the presence of at least one reforming catalyst under catalytic reforming conditions. A heavy aromatics bottoms stream is separated from the reformer's effluent in at least one separations step to produce the specified hydrocarbon-containing fluid.

The heavy aromatics bottoms fraction that is separated from the reformer effluent from a catalytic reforming process is typically a low sulfur content fraction, mainly as a result of the nature of a catalytic reforming process. During catalytic reforming, single-ring aromatic compounds of various types are typically the desired product, so a bottoms fraction may contain a reduced or minimized amount of single ring compounds. Additionally, the density of a bottoms fraction can be relatively low, indicating the presence of non-aromatic rings in the multi-ring compounds. Finally, a bottoms fraction can have a relatively low content of saturated aliphatic compounds. This contributes to the relatively high $S_{BN}$ of the bottoms fraction.

The heavy aromatics bottoms fraction from a catalytic reforming process is conventionally a stream that has limited value in a refinery setting. An example of a conventional disposition for the heavy aromatics bottoms fraction from a catalytic reforming process is to add it to a fuel oil pool. Given the relatively low sulfur content of such a bottoms fraction, adding the heavy aromatics bottoms fraction to a fuel oil pool is a substantial downgrade in value. Instead of downgrading the heavy aromatics bottoms fraction to fuel oil, in various aspects, the heavy aromatics bottoms fraction can be used as the hydrocarbon-containing fluid for upgrading of pyrolysis tar. This can allow the heavy aromatics bottoms fraction to become part of the naphtha and/or distillate fractions generated from the solvent-assisted tar conversion process, while also facilitating improved pyrolysis tar hydroprocessing during start-up and/or other times.

Certain aspects of the invention will now be described in more detail, which include reforming a naphtha to produce a reformer effluent, separating a heavy aromatics bottoms fraction from the reformer effluent in at least one separation step, and utilizing during at least one time interval at least a portion of the heavy aromatics bottoms fraction (or a stream derived therefrom) as the hydrocarbon-containing fluid when hydroprocessing a pyrolysis tar such as steam cracker tar. The invention is not limited to these aspects, and this description should not be interpreted as foreclosing other forms of hydrocarbon-containing fluid within the broader scope of the invention. For the purpose of this description and appended claims, the following terms are defined.

The "normal boiling point" of a liquid means that temperature at which the liquid is equal to 101.325 kPa. Normal boiling point and normal boiling point range can be measured by gas chromatograph distillation according to the methods described in ASTM D-6352-98 or D2887, as extended by extrapolation for material where at least a portion has a normal boiling point ≥700° C. at atmospheric pressure. Final boiling point means the temperature at which 99.5 wt. % of a particular sample has reached its normal boiling point. Initial boiling point means the temperature at which 0.5 wt. % of a particular sample has reached its normal boiling point.

A composition is primarily in the vapor, liquid, or solid phase when ≥50 wt. % of the composition is in the indicated phase at described conditions of temperature and pressure, e.g., ≥75 wt. %, such as ≥90 wt. %. The conditions are generally express, but may be implied.

A "raw" composition is a primarily liquid-phase composition comprising ≥25 wt. % of crude oil that has not been subjected to prior fractionation with reflux, e.g., ≥50 wt. %, such as ≥75 wt. %, or ≥90 wt. %. Raw crude oil includes those crude oils that have been subjected to certain optional processes, e.g., contaminant removal, such as one or more of salt removal, particulate removal, and water removal. "Crude oil" means a mixture comprising naturally-occurring hydrocarbon of geological origin, where the mixture (i) comprises ≥1 wt. % of resid, e.g., ≥5 wt. %, such as ≥10 wt. %, and (ii) has an API gravity ≤52°, e.g., ≤30°, such as ≤20°, or ≤10°, or <8°. Crude oil can be classified by API gravity, typically as light, medium, and heavy. Typically, heavy crude oil has an API gravity in the range of from 5° up to (but not including) 22°, medium crude oil has an API gravity in the range of from 22° to 30°, and light crude oil has an API gravity in the range of from >30° to about 52°. "Resid" means an oleaginous mixture that is non-boiling (e.g., thermally decomposes before boiling) or if able to boil has a normal boiling point range ≥1050° F. (566° C.).

"Pyrolysis tar" means tar produced during hydrocarbon pyrolysis. Steam cracker tar ("SCT") is pyrolysis tar produced by hydrocarbon pyrolysis in the presence of steam. SCT is typically a mixture of hydrocarbons having one or more aromatic components, and optionally further comprising non-aromatic and/or non-hydrocarbon molecules. SCT typically has a 90% Total Boiling Point ≥about 550° F. (290° C.) (e.g., ≥90.0 wt. % of the SCT molecules have a normal boiling point ≥550° F. (290° C.)). SCT can comprise ≥50.0 wt. % (e.g., ≥75.0 wt. %, such as ≥90.0 wt. %), based on the weight of the SCT, of hydrocarbon molecules (including mixtures and aggregates thereof) having (i) one or more aromatic components and (ii) a molecular weight that is ≥ to about Cis. SCT generally has a metals content, $\leq 1.0\times10^3$ ppm by weight (ppmw), based on the weight of the SCT (e.g., an amount of metals that is far less than that found in crude oil (or crude oil components) of the same average viscosity). "Tar Heavies" means a product of hydrocarbon pyrolysis, the TH having an atmospheric boiling point >565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. TH generally includes asphaltenes and other high molecular weight molecules. The invention is not limited to pyrolysis tars, such as SCT, and this description should not be interpreted as foreclosing other tars or similar compositions within the broader scope of the inventions, e.g., those derived from petroleum processes such as crude oil processing, resid processing, deasphalting, processing of atmospheric and/or vacuum tower bottoms, processing of compositions derived from catalytic cracking (e.g., processing of main column bottoms), compositions derived from hydroprocessing (e.g., processing of pitch obtained and/or derived from crude oil processing, resid processing including resid hydroprocessing, and the like) etc.

Crude oils and pyrolysis tars such as SCT can contain one or more of asphaltenes, precursors of asphaltenes, and particulates, typically in their resid portions. Asphaltenes are described in U.S. Pat. No. 5,871,634, which is incorporated herein by reference in its entirety. Asphaltene content can be measured by various techniques known to those of skill in the art, e.g., ASTM D3279 or ASTM D6560-17. Asphaltenes typically have an initial boiling point above 1200° F. (i.e., 1200° F.+ [about 650° C.+] material) and are typically insoluble in straight chain alkanes such as hexane and heptane. Asphaltenes are generally complex aromatic ring structures of large molecular weight, and may exist as colloidal dispersions. They are soluble in aromatic solvents like xylene and toluene. In various aspects, SCT has a n-heptane insoluble asphaltene content ("insolubles content") of at least about 5 wt. %, or at least about 10 wt. %, or at least about 15 wt. %, such as up to about 40 wt. %. Insolubles content is determined using the method disclosed in U.S. Patent Application Publication No. US2020-0063046, which is incorporated by reference herein its entirety.

Crude oils and pyrolysis tars such as SCT, and particularly resid portions thereof, can include "non-volatile components", meaning compositions (organic and/or inorganic) having a normal boiling point range ≥590° C. Non-volatile components may be further limited to components with a boiling point of about 760° C. or greater. Non-volatile components may include coke precursors, which are moderately heavy and/or reactive molecules, such as multi-ring aromatic compounds, which can condense from the vapor phase and then form coke under the specified steam cracking conditions. Crude oil and/or SCT, and more particularly the resid portions thereof, can contain particulates, meaning solids and/or semi-solids in particle form. Particulates may be organic and/or inorganic, and can include coke, ash, sand, precipitated salts, etc. Although precipitated asphaltenes may be solid or semi-solid, precipitated asphaltenes are considered to be in the class of asphaltenes, not in the class of particulates.

A tar feed is a composition that includes at least one tar, e.g., at least one pyrolysis tar. For example, a pyrolysis tar feed can comprise ≥50 wt. % or one or more pyrolysis tars based on the weight of the pyrolysis tar feed, e.g., ≥75 wt. %, such as ≥90 wt. %, or ≥95 wt. %, or ≥99 wt. %. An SCT feed is a composition that includes at least one SCT. For example, an SCT feed can comprise ≥50 wt. % or one or more SCT, based on the weight of the SCT feed, e.g., ≥75 wt. %, such as ≥90 wt. %, or ≥95 wt. %, or ≥99 wt. %. Tar feeds (such as pyrolysis tar feeds, e.g., SCT feeds) can have the form of a thermally-treated feed, e.g., can contain one or more pyrolysis tar compositions, such as those produced in accordance with the thermal treatments disclosed in U.S. Patent Application Publication No. 2020/0063046 and/or P.C.T. Patent Application Publication No. WO2018/11157.

Overview of Tar Hydroprocessing

Certain aspects of the invention will now be described in more detail with reference to FIG. 2, which include using the specified hydrocarbon-containing fluid to facilitate tar hydroprocessing in a solvent-assisted tar hydroprocessing process, e.g., a solvent-assisted pyrolysis tar hydroprocessing process, such as a solvent-assisted SCT hydroprocessing process (for simplicity, "tar hydroprocessing", "pyrolysis tar hydroprocessing", and "SCT hydroprocessing"). The invention is not limited to these aspects, and this description is not meant to foreclose other forms of tar hydroprocessing within the broader scope of the invention.

As shown, a tar feed, A, e.g., an tar feed, e.g., one containing one or more thermally-treated SCT (to lessen SCT reactivity), is conducted to one or more particulate-removal stages B, which includes, e.g., one or more centrifuges, to remove relatively large insoluble material, such as relatively large solids, typically those larger than 25 μm. Typically, the centrifuge operates at a temperature in a range of about 80° C. to 100° C., e.g., about 85° C. to 90° C. A utility fluid J (typically acting as a solvent for at least a portion of the SCT feed's hydrocarbon compounds) may be added to the SCT feed to form a tar-fluid mixture, which facilitate processing, e.g., by lessening viscosity. Utility fluid may be recovered from the process for recycle to as shown by J. It has been found to be advantageous to utilize the specified hydrocarbon-containing fluid as a substitute for the utility fluid at certain times and locations during the hydroprocessing.

Certain aspects of the invention include adding the hydrocarbon-containing fluid at various locations (not shown) in the process, e.g., by introducing it into one or more of line J, upstream of reactor F, and upstream of reactor G. The hydrocarbon-containing fluid can be used as a substitute for at least a portion of conventional supplemental utility fluid as otherwise may be used in tar hydroprocessing, e.g., as a primer fluid. The hydrocarbon-containing fluid can be used at any convenient time, such as during start-up of a pyrolysis process, e.g., when a recycle stream of liquid pyrolysis product is not available; when the amount of liquid pyrolysis product available for recycle is not sufficient to maintain desired hydroproces sing conditions; and/or when the changes to the quality of the liquid pyrolysis product reduce the suitability of the recycle stream for use as a utility fluid. Various aspects provide systems, processes, compositions, and methods for using the specified hydrocarbon-containing fluid to facilitate pyrolysis tar hydroprocessing, e.g., using the specified hydrocarbon-containing fluid as a replacement and/or substitute for at least a portion of conventional utility fluid and/or conventional supplemental utility fluid.

Figure 2:
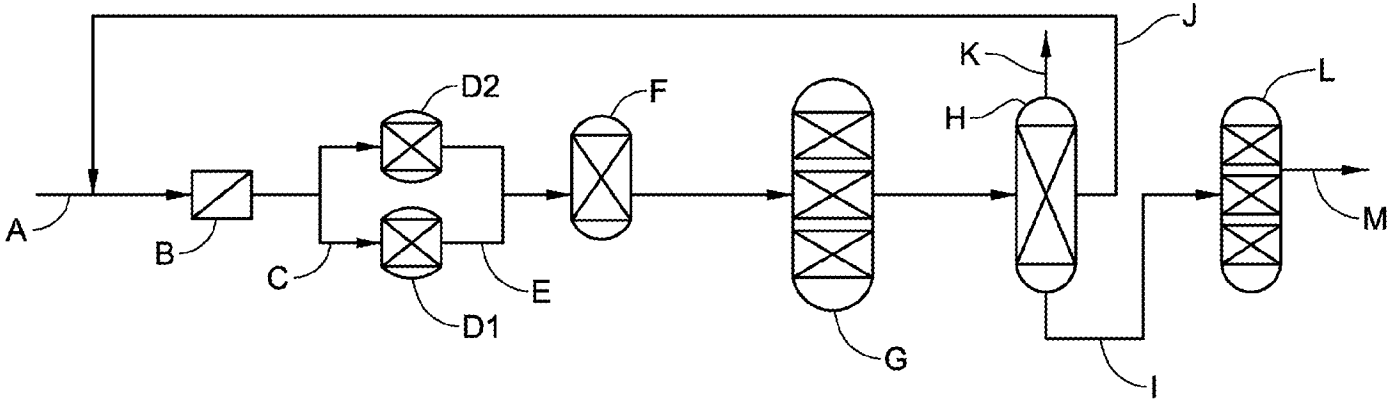
FIG. 2 shows an example of a configuration for hydroprocessing of pyrolysis tar.

Continuing with reference to FIG. 2, a second solids-removal stage (not shown), e.g., a second centrifuge or filter, may be included in the transport line J to remove relatively large insoluble material, e.g., relatively large solids, e.g., those larger than 25 μm. The "cleared" tar-fluid mixture is fed to one of a pair of guard reactors via a manifold C, which diverts the tar-fluid mixture toward guard reactor D1 or a guard reactor D2, as the case may be. When one of reactors D1 and D2 is receiving the tar-fluid mixture for reaction mode operation, the other is held offline, for instance for maintenance (e.g., for catalyst regeneration in regeneration mode operation), as disclosed in P.C.T. Patent Application Publication No. WO2018-111577. Effluent from the guard reactor passes through an outlet manifold E to a pretreatment hydroprocessing reactor F for further hydroprocessing under somewhat harsher conditions and/or with a more active catalyst. Effluent from the pretreatment hydroproces sing reactor passes to a main hydroprocessing reactor G for further hydroprocessing under yet more severe conditions. Effluent of reactor G passes to recovery facility H that includes at least one separation, e.g., fractionation, for separating from the effluent of G (i) a light stream K from which one or more additional streams may be separated, e.g., as a source of spent treat gas, (ii) a bottom fraction I which comprises hydroprocessed tar, and (iii) a mid-cut. At least a portion of the mid-cut can be recycled to as utility fluid via line J for forming the tar-fluid mixture. The bottoms fraction I is fed to a $2^{nd}$ Stage hydroprocessing reactor L for an additional hydroprocessing step that provides desulfurization under relatively severe conditions compared to those of reactor G. Separation of the mid-cut upstream of reactor L facilitates effective hydrodesulfurization in reactor L, but without undue hydrogenation of the mid-cut, thus avoiding a lessening the effectiveness of the mid-cut as an internally-sourced utility fluid. Effluent stream M from the $2^{nd}$ Stage hydroprocessing reactor is a low-sulfur hydroprocessed tar that is suitable for use as a fuel or fuel blendstock. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Reactors D, F, G, and L can operate under substantially the same process conditions, e.g., substantially the same temperature, pressure, molecular hydrogen partial pressure, molecular hydrogen supply rate, molecular hydrogen consumption rate, space velocity; and can utilize substantially the same hydroprocessing catalyst. Doing so, however, can result in an appreciable difference among the reactors in the time duration for which each can operate in reaction mode (i.e., pyrolysis tar hydroprocessing mode) before, e.g., an increase in reactor pressure drop indicates that a change from reaction mode to regeneration mode would be beneficial. Accordingly, in certain aspects, reactors D, F, G, and L typically operate under increasingly severe process conditions (e.g., conditions of greater temperature and/or lesser space velocity than its predecessor reactor), and each succeeding reactor may utilize a catalysts of increased activity over its predecessor.

In those aspects where substantially the same tar hydroprocessing conditions are used in each of reactors F, G, and L (and optionally D, F, G, and L), the reactors can each use substantially the same catalyst (e.g., a conventional hydroprocessing catalyst comprising one or more of Co, Ni, and Mo), and can operate under substantially the same process conditions including a space velocity (WHSV)≤1.0 $hr^{-1}$, e.g., in a range of from about 0.6 $hr^{-1}$ to 1.0 $hr^{-1}$ (weight of tar-fluid mixture per weight of catalyst per hour), a molecular hydrogen supply rate ≥100 standard cubic feet of molecular hydrogen per barrel of tar-fluid mixture (scf/Bbl), e.g., ≥1000, such as in a range of from 300 scf/Bbl (53 S $m^3/m^3$) to 5000 scf/Bbl (890 S $m^3/m^3$), or 1000 scf/Bbl to 5000 scf/Bbl, or a range of from 1000 scf/Bbl (178 S $m^3/m^3$) to 3000 scf/Bbl (534 S $m^3/m^3$); a temperature ≥260° C., and a molecular hydrogen partial pressure ≥0.1 MPa, or ≥1 MPa, or ≥10, or in a range of from 0.1 MPa to 20 MPa, or 1 MPa to 15 MPa. In specific aspects, the temperature in reactor G is ≥260° C., and the temperature in reactor L is in a range of from 375° C. to 390° C., with one or more of the other indicated process conditions being the same in reactors G and L.

In aspects where tar hydroprocessing conditions and hydroprocessing catalyst selection are different in in one or more of reactors, the following pyrolysis tar hydroprocessing conditions can apply: The guard reactor (D1 or D2 as the case may be) can utilize a conventional hydroprocessing catalyst, and can operate under mild hydroprocessing conditions, which can include a temperature ≤400° C., e.g., in a range of 250° C. to 280° C. and a weight hourly space velocity (WHSV)≥4 $hr^{-1}$, e.g., in a range of from 5 $hr^{-1}$ to 6 $hr^{-1}$. Pretreatment reactor F can utilize a hydroprocessing catalyst of similar or greater activity than that of reactor D, and can operates under pretreatment hydroprocessing conditions, which can include a temperature (TpT)≤400° C., e.g., in a range of from 260° C. to 300° C., a space velocity ($WHSV_{PT}$)≥0.3 $hr^{-1}$, e.g., ≥1 $hr^{-1}$, such as in a range of from 2 $hr^{-1}$ to 3 $hr^{-1}$, a total pressure ($P_{PT}$)≥8 MPa, and a molecular hydrogen supply rate of <3000 scf/Bbl (534 S $m^3/m^3$). Pretreatment hydroprocessing conditions can be selected to achieve a desired 566° C.+ conversion, typically in the range of from 0.5 wt. % to 5 wt. % substantially continuously for at least ten days. Reactor G can utilize a hydroprocessing catalyst of similar or greater activity than that of reactor F, and can operate under intermediate hydroprocessing conditions, which can include a temperature ("$T_1$")≥200° C., e.g., in a range of from 375° C. to 410° C., a total pressure ("$P_1$")≥3.5 MPa, e.g., ≥6 MPa, a space velocity ("$WHSV_1$")≥0.3 $hr^{-1}$, e.g., in a range of from 0.7 $hr^{-1}$ to 0.9 $hr^{-1}$, and a molecular hydrogen supply rate ≥1000 scf/Bbl (178 S $m^3/m^3$). Conditions can be selected within the intermediate hydroprocessing conditions to achieve a 566° C.+ conversion, of ≥20 wt. % substantially continuously for at least ten days at a molecular hydrogen consumption rate in the range of from 2200 scf/Bbl (392 S $m^3/m^3$) to 3200 scf/Bbl (570 S $m^3/m^3$). Reactor L can utilize a hydroprocessing catalyst having a greater activity than that of reactor G, and can operate under retreatment hydroprocessing conditions", which can include a temperature ($T_R$)≥360° C., e.g., in a range of from 375° C. to 425° C., a space velocity ($WHSV_R$)≤0.6 $hr^{-1}$, e.g., in a range of from 0.4 $hr^{-1}$ to 0.6 $hr^{-1}$, a molecular hydrogen supply rate ≥2500 scf/Bbl (445 S $m^3/m^3$); and a total pressure ("$P_R$")≥3.5 MPa, e.g., ≥6 MPa. Typically $WHSV_R$<$WHSV_I$.

Although it is not required, in any of these aspects (whether the hydroprocessing catalyst and process conditions in the reactors are alike or different) the molecular hydrogen can be supplied to reactors F, G, and L in stages. For example, 20 vol. % to 30 vol. % of the molecular hydrogen can be added upstream of reactor F; 30 vol. % to 50 vol. % of the molecular hydrogen can be added downstream of reactor F but upstream of reactor G; and ≥90% of the remainder (e.g., 100% of the remainder) of the molecular hydrogen can be added downstream of recovery facility H but upstream of reactor L. Total pressure in each of the hydroprocessing stages is typically regulated to maintain a flow of tar, tar feed, and tar-fluid mixture from one hydroprocessing stage to the next, e.g., with little or need for inter-stage pumping. When operated under these conditions using the specified catalyst, TH conversion is generally ≥25.0% on a weight basis, e.g., ≥50.0%.

Representative processes, methods, systems, apparatus, and compositions as may be used in tar hydroprocessing, such as the hydroprocessing of FIG. 2, will now be described in more detail. These include representative forms of the hydrocarbon-containing fluid; representative systems, apparatus, processes and methods for producing the hydrocarbon-containing fluid; representative forms of tars, including forms of SCT; representative systems, apparatus, processes and methods for producing an SCT feed; representative forms of utility fluid; representative systems, apparatus, processes and methods for producing utility fluid; representative systems, apparatus, processes and methods for removing solids from SCT and/or a tar-fluid mixture; representative forms of guard reactions; representative forms of pretreatment reactions, representative forms of a main hydroprocessing reactions; and certain forms of re-treatment hydroprocessing reactions will now be described in sequence. The invention is not limited to these, and these descriptions should not be interpreted as excluding other processes, methods, systems, apparatus, and compositions within the broader scope of the invention.

Hydrocarbon-Containing Fluid-Properties

The hydrocarbon-containing fluid can be used to facilitate tar hydroprocessing, e.g., by one or more of (i) replacing at least a portion of any primer fluid as may be utilized start a tar hydroprocessing process, (e.g., in at least partial substitution for the primer fluid described in U.S. Pat. No. 9,777,227, which is incorporated by reference herein in its entirety), (ii) adding the hydrocarbon-containing fluid at one or more locations in the tar hydroprocessing process to facilitate a change in composition in an internally-generated utility fluid, as may be needed in response to a change in tar feed composition and/or tar hydroprocessing conditions, and (iii) substituting the hydrocarbon-containing fluid for at least a portion of the internally-generated utility fluid, such as to facilitate the diversion of the internally-generated utility fluid to one or more of storage, further processing (e.g., blending), and product sales.

In various aspects, the hydrocarbon-containing fluid can have a $S_{BN}$ of 90 or more, or 100 or more, or 110 or more, or 120 or more, such as up to 200 or possibly still higher. The hydrocarbon-containing fluid can also have a normal boiling point range of 150° C. to 400° C. For example, 80 wt. % or more of the utility fluid can boil between 150° C. and 400° C., or 90 wt. % or more, or 95 wt. % or more, such as up to having substantially all of the utility fluid boil between 150° C. and 400° C. Additionally or alternately, the density of the hydrocarbon-containing fluid can be less than 0.99 $g/cm^3$, or 0.98 $g/cm^3$ or less, or 0.97 $g/cm^3$ or less, or 0.96 $g/cm^3$ or less, such as down to 0.92 $g/cm^3$ or possibly still lower. Increasing a utility fluid's density within a given boiling range can be an indicator of increasing aromatic content, as compounds including aromatic ring structures can tend to have substantially higher densities than compounds with similar numbers of rings but at least one non-aromatic ring. In some aspects, the hydrocarbon-containing fluid can also have a low bromine number, indicating a reduced or minimized presence of olefinic compounds. For example, the hydrocarbon-containing fluid can have a bromine number of less than 5.

A method of characterizing the solubility properties of a petroleum fraction can correspond to the toluene equivalence (TE) of a fraction, based on the toluene equivalence test as described for example in U.S. Pat. No. 5,871,634, which is incorporated herein by reference with regard to the definition for toluene equivalence, solubility number ($S_{BN}$), and insolubility number ($I_N$).

Briefly, the determination of IN and the $S_{BN}$ for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes (or asphaltene-like molecules) in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. It is noted that other test nonsolvents and test solvents could be used. In this description, solubility number and insolubility number are defined based on use of n-heptane and toluene.

A convenient volume ratio of oil to test liquid mixture is selected for the first test, for instance, 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes (or asphaltene-like molecules) are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes (or asphaltene-like molecules) and the maximum percent toluene that precipitates asphaltenes (or asphaltene-like molecules). More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[\frac{T_2 - T_1}{R_2 - R_1}\right]R_2, \tag{1}$$

and $S_{BN}$ is given by:

$$S_{BN} = I_N\left[1 + \frac{1}{R_2}\right] - \frac{T_2}{R_2}. \tag{2}$$

It is noted that additional procedures are available, such as those specified in U.S. Pat. No. 5,871,634, for $S_{BN}$ determination of oil samples that do not contain asphaltenes.

Hydrocarbon-Containing Fluid-Composition

The hydrocarbon-containing fluid's composition can also be characterized. For example, the hydrocarbon-containing fluid can include aromatic and/or non-aromatic and can contain a variety of substituents and/or heteroatoms. For example, the hydrocarbon-containing fluid can contain ≥60 wt. % of aromatic and non-aromatic ring compounds, or 70 wt. % or more, or 80 wt. % or more, such as having up to substantially all of the hydrocarbon-containing fluid correspond to aromatic and non-aromatic ring compounds.

In various aspects, the hydrocarbon-containing fluid can include 30 wt. % or more of cyclic compounds with a ring class of 1.5, or 35 wt. % or more, such as up to 55 wt. % or possibly still higher. The hydrocarbon-containing fluid can further include 20 wt. % or less of compounds with a ring class of 1.0 or less, or 15 wt. % or less, or 10 wt. % or less, such as down to having substantially no compounds with a ring class of 1.0 or less. Optionally, the hydrocarbon-containing fluid can also include 10 wt. % to 25 wt. % of compounds with a ring class of 2.5 or more, or 10 wt. % to 20 wt. %. It is noted that compounds with a ring class of 1.0 or less refers to compounds that include at least one ring. Aliphatic compounds are not included within the definition of compounds with a ring class of 1.0 or less. (A more detailed description of ring class is provided below.) Additionally or alternately, the hydrocarbon-containing fluid can include 10 wt. % or less of aliphatic compounds, or 5.0 wt. % or less, or 2.0 wt. % or less, such as down to having substantially no aliphatic compounds. Further additionally or alternately, the hydrocarbon-containing fluid can include 5.0 wt. % or less of unsaturated aliphatic compounds, or 2.0 wt. % or less, such as down to having substantially no unsaturated aliphatic compounds.

It is generally desirable for the hydrocarbon-containing fluid to be substantially free of compounds having terminal unsaturates, for example, vinyl aromatics, particularly in aspects utilizing a hydroprocessing catalyst having a tendency for coke formation in the presence of such compounds. The term "substantially free" in this context means that the hydrocarbon-containing fluid comprises ≤10.0 wt. % (e.g., ≤5.0 wt. % or ≤1.0 wt. %) vinyl aromatics, based on the weight of the hydrocarbon-containing fluid.

Certain compositional features of the hydrocarbon-containing fluid can be based on the types of ring structures contained therein. Compounds including ring structures can include aromatic rings, non-aromatic rings, or a mixture of aromatic and non-aromatic rings. The ring structures can correspond to rings that include heteroatoms (i.e., atoms different than carbon or hydrogen).

The term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure, are within the scope of the term "non-aromatic ring".

Examples of non-aromatic rings include saturated rings (e.g., cyclopentane, cyclohexane) and partially unsaturated rings (e.g., cyclopentene, cyclopenatadiene, cyclohexene and cyclohexadiene). Non aromatic rings (which in SCT are primarily six and five member non-aromatic rings), can contain one or more heteroatoms such as sulfur (S), nitrogen (N) and oxygen (O). Non limiting examples of non-aromatic rings with heteroatoms include tetrahydrothiophene, pyrrolidine, piperidine, and tetrahydrofuran.

The term "aromatic ring" means five or six atoms joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "aromatic ring". Non-limiting examples of five member and six member aromatic rings include benzene, toluene, thiophene, pyrrole, and furan.

When there is more than one ring in a molecular structure, the rings can be aromatic rings and/or non-aromatic rings. The ring to ring connection can be of two types: type (1) where at least one side of the ring is shared, and type (2) where the rings are connected with at least one bond. The type (1) structure is also known as a fused ring structure. The type (2) structure is also commonly known as a bridged ring structure. Examples of fused ring structures include naphthalene (aromatic), decahydronaphthalene (non-aromatic), and indane (mixture of aromatic and non-aromatic rings). A non-limiting example of a bridged ring structure is

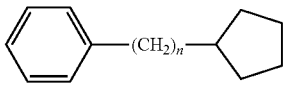

(1)

In Formula 1, n can correspond to any integer.

A ring class can be assigned to the various types of rings in the hydrocarbon-containing fluid. As described above, ring class is assigned, within each compound, based on a value of 0.5 for non-aromatic rings and 1.0 for aromatic rings. The hydrocarbon-containing fluid can then be characterized based on the weight percentage of compounds therein having a given ring class.

Representative Processes for Producing the Hydrocarbon-Containing Fluid

One representative process for producing the hydrocarbon-containing fluid includes catalytic reforming of a naphtha, a conventional method for producing $C_6$ to $C_8$ aromatics. For example, an aliphatic and/or naphthenic hydrocarbon mixture, such as a $C_5$-205° C. naphtha cut from a crude oil distillation unit, can react with one or more reforming catalysts to produce reformate. U.S. Pat. No. 7,197,367, which describes an example of a system and method for performing catalytic reforming on a suitable naphtha boiling range feed, is incorporated herein by reference for the limited purpose of describing formation of a catalytic reformate.

The selection of a naphtha feed to the reforming is not critical. For example, the naphtha feed can be produced by one or more of fluidized catalytic cracking, coking, and crude oil distillation. For example, the naphtha can be separated from a hydrocarbon feed comprising ≥25 wt. % of one or more of light, medium, and heavy crude oil. The crude oil can be a raw crude oil.

Naphtha can be separated from the crude oil in, e.g., an atmospheric distillation tower and/or vacuum distillation tower. The separated naphtha can comprise one or more of light, medium and heavy naphtha. The naphtha is characterized by true boiling point range (determined by A.S.T.M. D2892) and specific gravity. Light naphtha has a true boiling point range of from 10° C. to about 80° C., and a specific gravity in the range of from 0.66 to 0.70. Medium naphtha has a true boiling point range of from >80° C. to 140° C., and a specific gravity in the range of from >0.70 to about 0.74. Heavy naphtha has a true boiling point range of from >140° C. to 210° C., and a specific gravity in the range of from >0.74 to about 0.82. When the naphtha is separated from crude oil having a sulfur content ≥0.5 wt. %, the medium naphtha typically has, e.g., a sulfur content of ≥0.01 wt. %, and the heavy naphtha typically has, e.g., a sulfur content of ≥0.02 wt. %.

Although it is not required, naphtha separated from the crude oil (called "straight run" or "virgin" naphtha) can be subjected to one or more additional separations to produce a naphtha feed for reforming. Hydroprocessing can be used to lessen the effect that sulfur typically has on reformer catalyst activity. Hydroprocessing can convert at least a portion of any sulfur in the naphtha to forms of sulfur that have a normal boiling point outside of naphtha's boiling range. The hydroprocessing can be carried out before and/or after the additional separation(s), e.g. to achieve a naphtha feed for reforming having a sulfur content of ≤0.05 wt. %, e.g., Typically the naphtha feed to produce reformate has a sulfur content ≤0.05 wt. %, and comprises ≥50 wt. % heavy naphtha, e.g., ≥75 wt. %, such as ≥90 wt. %, or ≥99 wt. %, with ≥90 wt. % of the balance being medium naphtha and/or light naphtha, such as ≥99 wt. % of the balance being medium naphtha. In certain aspects, the naphtha is a heavy naphtha containing 35 vol. % to 65 vol. % of paraffinic hydrocarbon, 20 vol. % to 50 vol. % of naphthenic hydrocarbon, and 5 vol. % to 20 vol. % of aromatic hydrocarbon; and having a true boiling point range of 140° C. to 205° C., and a specific gravity in the range of from 0.76 to 0.81.

Generally, catalytic reforming involves a complex series of chemical reactions, including cracking, dehydrocyclization, dehydrogenation, and isomerization, to produce a product mixture containing a wide variety of aromatic compounds. Generally, the reactions can be designed to convert paraffinic compounds into cyclic compounds, and at least a portion of the cyclic compounds can be dehydrogenated to form desired aromatic compounds. The aromatic compounds can include benzene, toluene, and various $C_8$ aromatic products (para-xylene, ortho-xylene, meta-xylenes, and ethylbenzene). The aromatic compounds can also include a variety of heavy aromatics, such as mesitylene, pseudocumene, ethyltoluenes, and a variety of other structures including two or more aromatic and/or non-aromatic rings. Some heavy aromatics can be suitable for further processing, such as transalkylation, to provide a higher yield of desired aromatics. However, at least a portion of the reforming products can correspond to heavy compounds that form a bottoms stream after the target or desired products are recovered.

Although the invention is not limited thereto, conventional catalytic reforming processes can be used, e.g., one or more of POWERFORMING (a proprietary mark of ExxonMobil), CCR PLATFORMING (a proprietary mark of Universal Oil Products, and OCTANIZING (a proprietary mark of Axens). The catalytic reforming can be or include petrochemical reforming processes, such as those directed toward producing xylenes and other aromatics. Typically the reforming catalysts includes platinum dispersed on an acidic refractory support material. Process conditions typically include a temperature in the range of from 400° C. to 600° C., and a pressure in the range of 5 bar (absolute) to 25 bar (absolute). Typically, that portion of the reformer's effluent as would be primarily liquid phase at a temperature of 25° C. and a pressure of 1 bar (absolute) (i.e., the "reformate") comprises ≤0.01 wt. % of sulfur, e.g., ≤0.001 wt. %, 30 vol. % to 50 vol. % of paraffinic hydrocarbon, 5 vol. % to 10 vol. % of naphthenic hydrocarbon, and 45 vol. % to 60 vol. % of aromatic hydrocarbon. The reformate comprises ≥50 wt. % of $C_{5+}$ hydrocarbon, e.g., ≥75 wt. %, such as ≥90 wt. %, or ≥95 wt. %; and typically ≥50 wt. % of $C_{6+}$ hydrocarbon, e.g., ≥75 wt. %, such as ≥90 wt. %, or ≥95 wt. %.

The reformate portion of the effluent from a catalytic reforming process typically includes light ends with no aromatic rings, one or more desired fractions (such as xylenes or other single aromatics), and a variety of heavy compounds. A plurality of separation stages can be used to separate the desired single ring aromatic products from the light ends and the heavy compounds. As the desired single ring compounds are removed, one or more bottoms fractions can be formed. In some aspects, a plurality of separation stages can be used to produce desired streams of single ring aromatics. This results in a plurality of different bottoms fractions, including at least one heavy aromatics bottoms fraction.

FIG. 1 shows an example of a representative process flow for performing catalytic reforming and separating various products from the reformer effluent. In FIG. 1, a catalytic reformer 110 is used to reform a feedstock 105 to form a reformate stream 115. An example of a suitable feedstock 105 for catalytic reformer 110 can be a naphtha boiling range feed, such as a virgin or straight-run heavy naphtha fraction. The reformate can then be separated in a series of stages to generate various products. In the example shown in FIG. 1, the reformate 115 is initial separated in separation stage 120 to form a stream 122 including benzene, toluene, and optionally any lower boiling components in the reformate 115. Separation stage 120 also forms a first higher boiling fraction 125 that is passed into second separation stage 130. Second separation stage 130 separates the first higher boiling fraction 125 into a xylenes stream 132 and a second higher boiling fraction 135. In some aspects, at least a portion of second higher boiling fraction 135 can be used as an aromatic bottoms fraction 137 to form the hydrocarbon-containing fluid. In such aspects, aromatic bottoms fraction 137 can be referred to as a "second stage bottoms" fraction. Alternatively, second higher boiling fraction 135 can be passed into a third separation stage 140 to form a third overhead fraction 142 and a third higher boiling fraction 145. The composition of the third overhead fraction 142 and third higher boiling fraction 145 can be dependent on the type of aromatic products that are desired. In some aspects, third overhead fraction 142 can correspond to a $C_9$-$C_{11}$ fraction, so that the third higher boiling fraction 145 corresponds to a fraction that primarily contains compounds with a boiling point of 200° C. or higher. In other aspects, third overhead fraction 142 can correspond to a $C_9$ fraction, so that third higher boiling fraction 145 also includes $C_{10}$ and $C_{11}$ compounds. In any of the above aspects, at least a portion of third higher boiling fraction 145 can be used as an aromatic bottoms fraction 147 for forming the hydrocarbon-containing fluid. In such aspects, aromatic bottoms fraction 147 can be referred to as a "third stage bottoms" fraction.

Optionally, third higher boiling fraction 145 can be passed into a fourth separation stage to form a fourth overhead product 142 and a fourth aromatic bottoms fraction 147. Optionally, at least a portion of fourth aromatic bottoms fraction 147 (e.g., "fourth stage bottoms" fraction) can be used as the hydrocarbon-containing fluid. Optionally, third higher boiling fraction 145 can be passed into a fourth separation stage 150 to form a fourth overhead product 152 and a fourth aromatic bottoms fraction 157. Optionally, at least a portion of fourth aromatic bottoms fraction 157 (e.g., "fourth stage bottoms" fraction) can be used as the hydrocarbon-containing fluid.

The hydrocarbon-containing fluid, e.g., one that is or is derived from reformate as indicated, can substitute for at least a portion of the utility fluid of line J in FIG. 2, e.g., as a primer fluid until the process makes sufficient utility fluid for separation in separator H to supply line J. Representative utility fluids will now be described in more detail The invention is not limited to these utility fluids, and this description should not be interpreted as foreclosing other utility fluids within the broader scope of the invention.

Utility Fluids

The utility fluid typically comprises a mixture of multi-ring compounds. The rings can be aromatic or non-aromatic, and can contain a variety of substituents and/or heteroatoms. For example, the utility fluid can contain ring compounds in an amount ≥40.0 wt. %, ≥45.0 wt. %, ≥50.0 wt. %, ≥55.0 wt. %, or ≥60.0 wt. %., based on the weight of the utility fluid. In certain aspects, at least a portion of the utility fluid is obtained from the hydroprocessor effluent, e.g., by one or more separations. This can be carried out as disclosed in U.S. Pat. No. 9,090,836, which is incorporated by reference herein in its entirety. Conventional utility fluids can be used, but the invention is not limited thereto. Suitable utility fluids include those disclosed in U.S. Patent Application Publication No. 2020-006304 and P.C.T. Patent Application Publication No. WO2018-111577.

Typically, the utility fluid comprises aromatic hydrocarbon, e.g., ≥25.0 wt. %, such as ≥40.0 wt. %, or ≥50.0 wt. %, or ≥55.0 wt. %, or ≥60.0 wt. % of aromatic hydrocarbon, based on the weight of the utility fluid. The aromatic hydrocarbon can include, e.g., one, two, and three ring aromatic hydrocarbon compounds. For example, the utility fluid can comprise ≥15 wt. % of 2-ring and/or 3-ring aromatics, based on the weight of the utility fluid, such as ≥20 wt. %, or ≥25.0 wt. %, or ≥40.0 wt. %, or ≥50.0 wt. %, or ≥55.0 wt. %, or ≥60.0 wt. %. Utilizing a utility fluid comprising aromatic hydrocarbon compounds having 2-rings and/or 3-rings is advantageous because utility fluids containing these compounds typically exhibit an appreciable $S_{BN}$.

The utility fluid typically has an A.S.T.M. D86 10% distillation point ≥60° C. and a 90% distillation point ≤425° C., e.g., ≤400° C. In certain aspects, the utility fluid has a true boiling point distribution with an initial boiling point ≥130° C. (266° F.) and a final boiling point ≤566° C. (1050° F.). In other aspects, the utility fluid has a true boiling point distribution with an initial boiling point ≥150° C. (300° F.)

and a final boiling point ≤430° C. (806° F.). In still other aspects, the utility has a true boiling point distribution with an initial boiling point ≥177° C. (350° F.) and a final boiling point ≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the utility fluid has a true boiling point distribution having an initial boiling point ≥130° C. and a final boiling point ≤566° C.; and/or comprises ≥15 wt. % of two ring and/or three ring aromatic compounds.

2-dimensional gas chromatography (2D GC) can be used for characterizing the composition (including ring classes) of the utility fluid and/or the specified hydrocarbon-containing fluid (or even a tar or tar fraction). According to this method, a sample is subjected to two sequential chromatographic separations. The first separation is a partial separation by a first or primary separation column. The partially separated components are then injected into a second or secondary column where they undergo further separation. The two columns usually have different selectivities to achieve the desired degree of separation. An example of 2D GC may be found in U.S. Pat. No. 9,777,227, and in U.S. Pat. No. 5,169,039, which is incorporated by reference in its entirety.

The 2D GC measurements described herein utilized an Agilent 6890 gas chromatograph (Agilent Technology, Wilmington, Del.) configured with inlet, columns, and detectors. A split/splitless inlet system with an eight-vial tray autosampler is used. The two-dimensional capillary column system utilized a non-polar first column (BPX-5, 30 meter, 0.25 mm I.D., 1.0 μm film), and a polar (BPX-50, 2 meter, 0.25 mm I.D., 0.25 μm film), second column. Both capillary columns are obtained from SGE Inc. Austin, Tex. A looped single jet thermal modulation assembly (ZOEX Corp. Lincoln, Nebr.) which is a liquid nitrogen cooled "trap-release" dual jet thermal modulator is installed between these two columns A flame ionization detector (FID) is used for the signal detection. A 1.0 microliter sample is injected with 25:1 split at 300° C. from Inlet. Carrier gas flow is substantially constant at 2.0 mL/min. The oven is programmed from 60° C. with 0 minute hold and 3.0° C. per minute increment to 390° C. with 0 minute hold. The total GC run time is 110 minutes. The modulation period is 10 seconds. The sampling rate for the detector is 100 Hz. Quantitative analysis of the 2D GC data is performed utilizing a commercial program ("Transform" (Research Systems Inc. Boulder, Colo.).

Referring again to FIG. 2, a tar feed, A, e.g., a pyrolysis tar feed, such as SCT feed is provided for combining with utility fluid J to facilitate tar hydroprocessing. Aspects of the invention will now be described in more detail, with respect to tar feeds comprising one or more SCT. The invention is not limited to SCT feeds nor to any particular SCT, and this description should not be interpreted as foreclosing any other tar feed within the broader scope of the invention.

SCT and the Production of SCT by Steam Cracking

Steam cracker effluent is typically a mixture comprising pyrolysis tar and precursors thereof, molecular hydrogen, and typically also at least some unreacted feed. SCT typically comprises ≥90 wt. % of that part of the steam cracker effluent having an atmospheric boiling point of ≥290° C. SCT typically has a boiling point of at least about 550° F.+(~288° C.+), e.g., 1050° F.+, and may be a non-boiling residue separated from steam cracker effluent. SCT can have a T5 boiling point (temperature at which 5 wt. % will boil off) of at least about 550° F. (~288° C.). The final boiling point of SCT is typically about 1450° F. (~788° C.) or less. SCT boiling points and/or fractional weight distillation points, when applicable, can be determined by, for example, ASTM D2892. Although pyrolysis tars such as SCT can be referred to as a "pyrolysis fuel oil", and can be used as a relatively low-value fuel oil and/or fuel oil blendstock, those skilled in the art will appreciate that the term "fuel oil" also encompasses compositions that do not contain pyrolysis tar, e.g., gas oils such as steam cracker gas oil.

Aspects of the invention which include producing SCT by steam cracking will now be described in more detail. The invention is not limited to these aspects, and this description should not be interpreted as foreclosing other aspects of tar production within the broader scope of the invention, such as those which do not include steam cracking.

Steam Cracking

A steam cracking plant typically comprises a furnace facility for producing steam cracker effluent and a recovery facility for removing from the steam cracker effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. A hydrocarbon composition (i.e., a composition comprising hydrocarbon) is introduced into tubular coils (convection coils) located in the convection section. A steam composition (i.e., a composition comprising steam) is also introduced into the convection coils, where it combines with the hydrocarbon composition to produce a steam cracking feed. Indirect heating by the flue gas and direct heating by the steam leads to vaporization of at least a portion of the steam cracking feed's hydrocarbon composition.

One suitable steam cracking feed comprises ≥1.0 wt. %, e.g., ≥10 wt. %, such as ≥25.0 wt. %, or ≥50.0 wt. % (based on the weight of the steam cracking feed) of a hydrocarbon composition that is primarily in the liquid and/or solid phase at ambient temperature and atmospheric pressure, e.g., ≥50 wt. % of the hydrocarbon composition is in the liquid and/or solid-phase at a temperature of 25° C. and a pressure of 1 bar (absolute), such as ≥75 wt. %, or ≥90 wt. %. In certain aspects, the hydrocarbon composition includes ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. The hydrocarbon composition can include non-volatile components, e.g., ≥1 wt. % of non-volatile components, based on the weight of the hydrocarbon, such as ≥5 wt. %, or ≥25 wt. %, or in the range of 5 wt. % to 50 wt. %. The hydrocarbon composition can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 wt. % of a particular sample has reached its boiling point. The hydrocarbon composition can include crude oil, e.g., one that (i) comprises hydrocarbon and (ii) contains ≥5 wt. % of non-volatile components based on the weight of the crude oil.

In certain aspects, the hydrocarbon composition comprises crude oil and the naphtha feed to the reforming is separated from a crude oil. Although these can be the same crude oil, e.g., each obtained from the same source of crude oil, this is not required. For it is an advantage of the invention that the naphtha and SCT can be produced in different locations from different feeds in response to local efficiency and financial advantages. Separation of the naphtha feed, the naphtha reforming, the SCT production, and the SCT hydroprocessing can be carried out in the same or different locations.

In aspects where the steam cracking feed's hydrocarbon composition comprises crude oil or a stream derived from crude oil, the steam cracking furnace can have at least one vapor/liquid separation device (sometimes referred to as flash pot or flash drum) integrated therewith. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entireties.

A steam cracking feed containing vaporized hydrocarbon, e.g., from vapor-liquid-separator overhead or from convection coils that received vapor-liquid separator overhead, is transferred via cross-over piping from the convection coils to one or more tubular coils ("radiant coils") located in the radiant section. Indirect radiant heating of the steam cracking feed in the radiant coils results in cracking of at least a portion of the steam cracking feed's hydrocarbon composition in the presence of the steam composition. More than one steam cracking furnace can be used, and these can be operated (i) in parallel, where a portion of the steam cracking feed being transferred to each of a plurality of furnaces and/or (ii) in series, where at least a second furnace is located downstream of a first furnace, the second furnace being utilized, e.g., for cracking any unreacted steam cracking feed in the first furnace's steam cracker effluent.

Conventional hydrocarbon compositions, steam compositions, steam cracking feeds, and steam cracking processes, can be utilized, but the invention is not limited thereto. Suitable compositions, feeds, and processes are disclosed, e.g., in U.S. Patent Application Publication No. 2020-006304 and P.C.T. Patent Application Publication No. WO2018-111577, which are incorporated by reference herein in their entireties. Steam cracker effluent is conducted out of the radiant section and is quenched, typically with water and/or quench oil. The quenched steam cracker effluent ("quenched effluent") is conducted away from the furnace facility to the recovery facility, for separation and recovery of reacted and unreacted components of the steam cracking feed.

Besides SCT, the quenched steam cracker effluent typically comprises (i) a primarily vapor-phase component comprising, e.g., one or more of acetylene, ethylene, propylene, butenes, and (ii) primarily liquid-phase component comprising, e.g., $C_{5+}$ hydrocarbon, and mixtures thereof. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, etc. The liquid-phase products are generally separated from the quenched effluent or a stream derived therefrom in one or more separation stages. Conventional separation equipment can be utilized in the separation stage, e.g., one or more flash drums, fractionators, water-quench towers, indirect condensers, etc., such as those described in U.S. Pat. No. 8,083,931, which is incorporated by reference herein in its entirety.

In certain aspects, SCT can be removed from the quenched steam cracker effluent in one or more separation stages, e.g., as a bottoms stream from one or more tar drums or a primary fractionator. For example, SCT can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

Representative SCTs will now be described in more detail. The invention is not limited to these SCTs, and this description is not meant to foreclose the processing of other pyrolysis tars within the broader scope of the invention.

Representative Steam Cracker Tars

In certain aspects the SCT is obtained as a bottoms stream from a tar knock-out drum and/or primary fractionator. Typically such a bottoms stream comprises ≥90.0 wt. % SCT, based on the weight of the bottoms stream, e.g., ≥95.0 wt. %, such as ≥99.0 wt. %. More than 90 wt. % of the remainder of such a bottom stream's weight (e.g., the part of the stream that is not SCT, if any) is typically particulates. The SCT can have, e.g., a boiling range ≥about 550° F. (290° C.) and can comprise molecules and mixtures thereof having a number of carbon atoms ≥about 15.

In certain aspects, the SCT has one or more of (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.19 g/cm$^3$, e.g., in the range of 1.07 g/cm$^3$ to 1.18, such as g/cm$^3$; and (iv) a 50° C. viscosity ≥200 cSt, e.g., ≥600 cSt, such as ≥$1.0\times10^3$ cSt, or ≥$1.0\times10^4$ cSt, or ≥$1.0\times10^5$ cSt, or ≥$1.0\times10^6$ cSt, or ≥$1.0\times10^7$ cSt, as determined by A.S.T.M. D445. Alternatively or in addition, the SCT can have one or more of an initial (normal) boiling point ≥290° C., an API gravity (measured at a temperature of 15.8° C.) of ≤8.5°, such as ≤8.0°, or ≤7.5°; a 50° C. viscosity in the range of 200 cSt to $1.0\times10^7$ cSt, e.g., $1\times10^3$ cSt to $1.0\times10^7$ cSt; an $I_N$>80; and an insolubles content ≥0.5 wt. %, e.g., ≥1 wt. %, such as ≥2 wt. %, or ≥4 wt. %, or ≥5 wt. %, or ≥10 wt. %. A particular SCT has a normal boiling point ≥290° C., a viscosity at 15° C. ≥$1\times10^4$ cSt, and a density ≥1.1 g/cm$^3$.

The SCT feed can comprise one SCT or a mixture of SCTs, and optionally other compositions such as steam cracker gas oil. In certain aspects, however, the SCT feed comprises ≥50 wt. % of one SCT, e.g., ≥75 wt. %, such as ≥90 wt. %, or ≥99 wt. When the SCT is a mixture, it is typical for at least 70 wt. % of the mixture to have an initial boiling point of at least 290° C., and include. When the mixture comprises first and second pyrolysis tars (one or more of which is optionally an SCT)≥90 wt. % of the second pyrolysis tar optionally has an initial boiling point ≥290° C. In aspects where steam cracking feed does not contain an appreciable amount of sulfur, the SCT can comprise ≤0.5 wt. % sulfur, e.g., ≤0.1 wt. %, such as ≤0.05 wt. % sulfur, based on the weight of the SCT.

Typically, the SCT contains olefinic hydrocarbon which contribute to SCT reactivity (e.g., a tendency to foul the hydroprocessing reactor) under hydroprocessing conditions. One or more thermal treatments can be carried out to decrease an SCT feed's (or SCT's) olefin content, e.g., to an amount that is ≤10.0 wt. %, e.g., ≤5.0 wt. %, such as ≤2.0 wt. %, based on the weight of the SCT feed. More particularly, a thermal treatment can decrease the amount of (i) vinyl aromatics in the SCT feed and/or (ii) aggregates in the SCT feed which incorporate vinyl aromatics to ≤5.0 wt. %, e.g., ≤3 wt. %, such as ≤2.0 wt. %, based on the weight of the SCT feed.

Tar Thermal Treatment, Solids Removal, and Tar-Fluid Mixture

Certain forms of thermal treatment and solids removal will now be described in more detail with reference to FIGS. 2 and 3. The invention is not limited to these aspects, and this description is not meant to foreclose other thermal treatments within the broader scope of the invention, such as those that do not utilize a thermal treatment and/or a solids removal stage.

Thermally treating a tar to reduce its reactivity can be accomplished in a cold tar recycling process with some minor modification, e.g. by reducing the flow of cold tar back into the process as described further below. Thermal treatment kinetics suggests that a reaction temperature of 200° C. to 300° C. with a residence time of a few minutes, e.g. 2 min., to >30 min., are effective in reducing tar reactivity. The higher the thermal treating temperature, the shorter the thermal treatment reaction time or residence time can be. For example, at 300° C., a residence time of 2-5 minutes may be adequate. At 250° C., a residence time of ~30 min gives similar reduction in reactivity. Pressure has little impact on thermal treatment kinetics and so the thermal treatment can be performed at ambient pressure or at the pressure of the outlet of the tar knockout process feeding the presently disclosed tar upgrading process. Conventional thermal treatments can be used, but the invention is not limited thereto. Suitable thermal treatments are disclosed in U.S. Patent Application Publication No. 2020-006304 and P.C.T. Patent Application Publication No. WO2018-111577.

Although SCT feed reactivity can be lessened by a thermal treatment of the tar-fluid mixture, it is typical to carry out the thermal treatment of the SCT feed (or of the individual SCTs in the SCT feed) before forming the tar-fluid mixture. In certain aspects, the amount of utility fluid and/or hydrocarbon-containing fluid utilized used for viscosity reduction during SCT thermal treatment (e.g., during SCT heat soaking in a tar knock-out drum) be controlled to ≤10 wt. % based on the combined weight of the SCT and the fluid(s).

Figure 3:
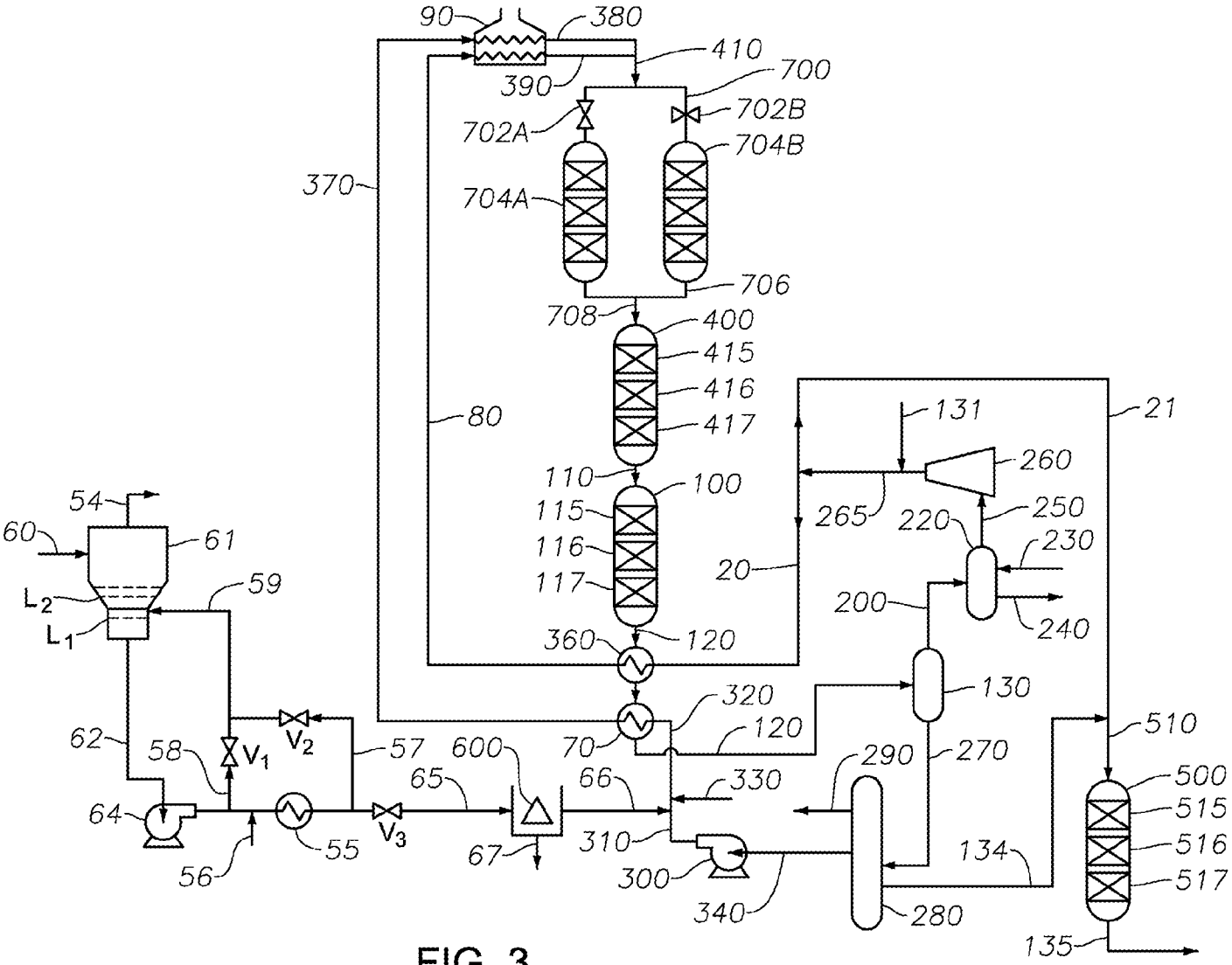
FIG. 3 shows another example of a configuration for hydroprocessing of pyrolysis tar.

FIG. 3 schematically shows a system and process for hydroprocessing and SCT feed in the presence of the hydrocarbon-containing fluid and the utility fluid. The system and process includes SCT feed pretreatment stages including (i) a tar knock-out drum 61 and associated valves ($V_1$-$V_3$), conduits 56-59 and 62, pump 64, and heat exchanger 55 for thermally-treating an SCT feed, and (ii) one or more solids-removal (e.g., insolubles-removal) stages 600.

The thermal treatment is carried out by adjusting valves $V_1$-$V_3$ to achieve a predetermined SCT temperature for a predetermined residence time to achieve a predetermined SCT feed's reactivity (e.g., a predetermined bromine number) by a predetermined amount. For example, an SCT feed can be maintained within a temperature range of from 20° C. to 360° C., or from 200° C. to 250° C. or from 225° C. to 275° C., for a time in the range of from 2 to 30 minutes, e.g., 2 to 5 minutes, or 5 to 20 minutes or 10 to 20 minutes. In certain aspects, the thermal treatment is carried out in a temperature range of from 200° C. to 300° C., typically 250° C. to 280° C., for a time in the range of from 2 to 15 minutes. In other aspects, the thermal treatment is carried out for a time in the range of from 2 to 15 minutes at a temperature in a range of about (i) 300° C.+/−60° C., e.g., 300° C.+/−50° C., such as 300° C.+/−25° C., or 300° C.+/−10° C., or (ii) 250° C.+/−60° C., e.g., 250° C.+/−50° C., such as 250° C.+/−25° C., or 250° C.+/−10° C.

The specified thermal treatment can be carried out under predetermined conditions of temperature and residence time to achieve a predetermined bromine number ("BN") in the tar-fluid mixture that is ≤18 BN.

Although it is typical to carry out SCT thermal treatment in one or more tar drums and related piping, the invention is not limited thereto For example, when the thermal treatment includes heat soaking, the heat soaking can be carried out at least in part in one or more soaker drums and/or in vessels, conduits, and other equipment (e.g. fractionators, water-quench towers, indirect condensers) associated with, e.g., (i) separating the pyrolysis tar from the pyrolysis effluent and/or (ii) conveying the pyrolysis tar to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with utility fluid.

In the forms of thermal treatment shown in FIG. 3, a quenched effluent from a steam cracker furnace facility is conducted via line 60 to a tar knock out drum 61. Cracked gas is removed from the drum via line 54. SCT condenses in the lower region of the drum (the boot region as shown), and a withdrawn stream of SCT is conducted away from the drum via line 62 to pump 64. A filter (not shown in the figure) for removing large solids, e.g. ≥10,000 μm diameter, from the SCT stream may be included in the line 62. After pump 64, a first recycle stream 58 and a second recycle stream 57 are diverted from the withdrawn stream. The first and second recycle streams are combined as recycle to drum 61 via line 59. One or more heat exchangers 55 is provided for cooling the SCT in lines 57 (shown) and 65 (not shown) e.g., against water. Line 56 provides an optional flux of utility fluid if needed. Valves $V_1$, $V_2$, and $V_3$ regulate the amounts of the withdrawn stream that are directed to the first recycle stream, the second recycle stream, and a stream conducted to solids separation, stage 600, via line 65. Lines 58, 59, and 62 can be insulated to maintain the temperature of the SCT within the desired temperature range for the thermal treatment. The thermal treatment time can be increased by increasing SCT flow through valves $V_1$ and $V_2$, which raises the SCT liquid level in drum 61 from an initial level, e.g., $L_1$, toward $L_2$.

As shown in the aspects of FIG. 3, the thermally-treated (and less-reactive) SCT is conducted to solids removal stage 600. The SCT feed is conveyed via line 66 to a hydroprocessing facility as shown. Solids removed from the SCT are conducted away via line 67. Conventional solids removal stages can be used, but the invention is not limited thereto. Suitable solids-removal stages are disclosed, e.g., in P.C.T. Patent Application Publication No. WO2018-111577 in U.S. Patent Application Publication No. 2015-0361354, which is incorporated by reference herein in its entirety. For example, solids can be removed from a tar-fluid mixture in a temperature in the range of from 80° C. to 100° C. using a centrifuge.

When solids removal stage 600 includes at least one centrifuge, the centrifuging is typically carried out after the SCT feed has been combined with at least part of the utility fluid and/or at least part of the hydrocarbon-containing fluid, i.e., at least part of the total amounts of those fluids in the tar-fluid mixture. Referring to FIG. 2, sufficient utility fluid can be obtained for effective centrifuging can typically be obtained during steady-state operations as recycle from separation stage H via line J. Referring now to FIG. 3, utility fluid can be obtained as a mid-cut recycle from separator 280 via lines 310 and 56 (for simplicity in FIG. 3, a connection of these lines is not shown,). During time periods when sufficient recycle is not available, e.g., during a change from one SCT Feed to another, or during hydroprocessing start-up, a sufficient amount of the hydrocarbon-containing fluid can be introduced via line 56 to facilitate effective centrifugation. Any suitable centrifuge may be used, including those industrial-scale centrifuges available from Alfa Laval. The feed to the centrifuge may be a tar-fluid mixture comprising utility fluid and a tar composition (thermally-treated tar). The amount of utility fluid is controlled such that the density of tar-fluid mixture at the centrifugation temperature, typically 50° C. to 120° C., or from 60° C. to 100° C., or from 60° C. to 90° C., is substantially the same as the desired feed density (1.02 g/ml to 1.06 to g/ml at 80° C. to 90° C.).

Continuing with FIG. 3, the thermally treated tar stream is conducted via line 65 through valve V3 into a solids removal stage 600. The SCT feed is conducted via line 66 storage and/or the specified hydroprocessing. At least a portion of solids removed during centrifuging are conducted away via line 67, e.g., for storage or further processing. If less utility fluid or hydrocarbon-containing fluid is added to the SCT feed before the solids removal stage than is needed to form the tar-fluid mixture, additional utility fluid can be added to the partially-formed tar-fluid mixture via line 310 and/or additional hydrocarbon-containing fluid can be added via line 330.

The relative amounts of utility fluid and SCT feed in the tar-fluid mixture for hydroprocessing are generally in the range of from about 20.0 wt. % to about 95.0 wt. % of the tar and from about 5.0 wt. % to about 80.0 wt. % of the utility fluid, based on the weight of the tar-fluid mixture. For example, the relative amounts of utility fluid and tar during hydroprocessing can be in the range of (i) about 20.0 wt. % to about 90.0 wt. % of the tar and about 10.0 wt. % to about 80.0 wt. % of the utility fluid, or (ii) from about 40.0 wt. % to about 90.0 wt. % of the tar, and from about 10.0 wt. % to about 60.0 wt. % of the utility fluid. In an embodiment, the utility fluid: tar weight ratio can be ≥0.01, e.g., in the range of 0.05 to 4.0, such as in the range of 0.1 to 3.0, or 0.3 to 1.1. The tar-fluid mixture can comprise, e.g., (i) about 20.0 wt. % to about 90.0 wt. % of SCT feed and about 10.0 wt. % to about 80.0 wt. % of the utility fluid, or (ii) from about 40.0 wt. % to about 90.0 wt. % of the SCT feed and from about 10.0 wt. % to about 60.0 wt. % of the utility fluid, the weight percents being based on the weight of the tar-fluid mixture. In certain aspects, the tar: utility fluid weight ratio can be 1.0 or more, such as up to 10.

In certain aspects, the tar-fluid mixture is subject to additional processes to further decrease reactivity before hydroprocessing in the main hydroprocessing reactor (reactor G of FIG. 2, corresponding to reactor 100 of FIG. 3) under intermediate hydroprocessing conditions. These additional processes are collectively called "pretreatment" and include pretreatment hydroprocessing in a guard reactor (reactors D1 and D2 of FIG. 2, corresponding to reactors 704A and 704B of FIG. 3) and in a pretreatment reactor (reactor F of FIG. 2, corresponding to reactor 400 of FIG. 3) before additional hydroprocessing in intermediate hydroprocessing reactor 100.

Certain forms of guard reactors and certain forms of pretreatment reactors will now be described in more detail with reference to FIG. 3. The invention is not limited to these aspects, and this description should not be interpreted as foreclosing other aspects of the invention that do not include guard and/or pretreatment reactors.

Representative Guard Reactors and Pretreatment Reactor

Guard reactor (e.g. 704A, 704B in FIG. 3) is used to protect downstream reactors from fouling from reactive olefins and solids. In a preferred configuration (illustrated in FIG. 2), two guard reactors operate in alternating mode—one on-line with the other off-line, e.g., for catalyst replacement and/or regeneration. When one of the guard reactors exhibits an undesirable increase in pressure drop, it is brought off-line so that it can be serviced and restored to condition for continued guard reactor operation. Restoration while off-line can be carried out, e.g., by replacing reactor packing and replacing or regenerating the reactor's internals, including catalyst. A plurality of (online) guard reactors can be used. Although the guard reactors can be arranged serially it is more typical for at least two guard reactors to be arranged in parallel, as in FIG. 3. Conventional guard reactors can be used, such as those disclosed in P.C.T. Patent Application Publication No. WO2018/11157, but the invention is not limited thereto.

As shown, the tar-fluid mixture of line 310 is conducted to a first pre-heater 70 for preheating, and the pre-heated mixture is conducted to a supplemental pre-heating stage 90 via conduit 370. Supplemental pre-heater stage 90 can be, e.g., a fired heater. Recycled treat gas is obtained from conduit 265 and, if necessary, is mixed with fresh treat gas, supplied through conduit 131. The treat gas is conducted via conduit 20 through a second pre-heater 360, before being conducted to the supplemental pre-heat stage 90 via conduit 80.

The pre-heated tar-fluid mixture (from line 380) is combined with the pre-heated treat gas (from line 390) and then conducted via line 410 to guard reactor inlet manifold 700. Mixing means (not shown) can be utilized for combining the pre-heated tar-fluid mixture with the pre-heated treat gas in guard reactor inlet manifold 700. The guard reactor inlet manifold directs the combined tar-fluid mixture and treat gas to online guard reactor, e.g. 704A, via an appropriate configuration of guard reactor inlet valves 702A, shown open, and 702B shown closed. An offline guard reactor 704B is illustrated, which can be isolated from the pretreatment inlet manifold by the closed valve 702B and a second isolation valve (not shown) downstream of the outlet of reactor 704B. On-line reactor 704A can also be brought off-line, and isolated from the process, when reactor 704B is brought on-line. Reactors 704A and 704B are typically brought off-line in sequence (one after the other) so that one of 704A or 704B is on-line while the other is off-line, e.g., for regeneration. Effluent from the online guard reactor(s) is conducted to further downstream processes via a guard reactor outlet manifold 706 and line 708.

The guard reactor can be operated under guard reactor hydroprocessing conditions to achieve a typical run-length of 1.5 to 6 months. Typical guard reactor conditions include a temperature in the range of from 200° C. to 300° C., more typically 200° C. to 280° C., or 250° C. to 280° C., or 250° C. to 270° C., or 260° C. to 300° C.; a total pressure in the range of from 1000 psi-absolute (psia)—1600 psia; typically 1300 psia to 1500 psia, a space velocity ("WHSV") in the range of from 5 $hr^{-1}$ to 7 $hr^{-1}$. The guard reactor contains a catalytically-effective amount of at least one hydroprocessing catalyst. Typically, upstream beds of the reactor include at least one catalyst having de-metallization activity, e.g., relatively large-pore catalysts to capture metals in the feed.

Beds located further downstream in the reactor typically contain at least one catalyst having activity for olefin saturation, e.g., catalyst containing Ni and/or Mo.

As shown in FIG. 3, the tar-fluid mixture from the guard bed is conducted to pretreatment reactor 400 for hydroprocessing. The pretreatment hydroprocessing is typically carried out under the pretreatment hydroprocessing conditions to produce a pretreatment hydroprocessor (pretreater) effluent.

In certain aspects, pretreatment hydroprocessing is carried out in at least one hydroprocessing zone located in at least one pretreatment reactor. The pretreatment reactor can be in the form of a conventional hydroprocessing reactor, but the invention is not limited thereto. Suitable pretreatment reactors and process conditions are disclosed in U.S. Patent Application Publication No. 2020/0063046 and P.C.T. Patent Application Publication No. WO2018/11157.

Representative pretreatment hydroprocessing conditions, include e.g., one or more of $T_{PT}$≥150° C., e.g., ≥200° C. but less than $T_I$ (e.g., $T_{PT}$≤$T_I$−10° C., such as $T_{PT}$≤$T_I$−25° C., such as $T_{PT}$≤$T_I$−50° C.), a total pressure $P_{PT}$ that is ≥8 MPa but less than $P_I$, $WHSV_{PT}$≥0.3 $hr^{-1}$ and greater than $WHSV_I$ (e.g., $WHSV_{PT}$>$WHSV_I$+0.01 $hr^{-1}$, such as ≥$WHSV_I$+0.05 $hr^{-1}$, or ≥$WHSV_I$+0.1 $hr^{-1}$, or ≥$WHSV_I$+0.5 $hr^{-1}$, or ≥$WHSV_I$+1 $hr^{-1}$, or ≥$WHSV_I$+10 $hr^{-1}$, or more), and a molecular hydrogen consumption rate in the range of from 150 (S $m^3/m^3$) to about 400 S $m^3/m^3$ (845 scf/Bbl to 2250 scf/Bbl but less than that of intermediate hydroprocessing. The Pretreatment Hydroprocessing Conditions typically include $T_{PT}$ in the range of from 260° C. to 300° C.; $WHSV_{PT}$ in the range of from 1.5 $hr^{-1}$ to 3.5 $hr^{-1}$, e.g., 2 $hr^{-1}$ to 3 $hr^{-1}$; a $P_{PT}$ in the range of from 6 MPa to 13.1 MPa; and a molecular hydrogen consumption rate in the range of from 100 scf/Bbl (18 S $m^3/m^3$) to 600 scf/Bbl (107 S $m^3/m^3$). To achieve the desired molecular hydrogen partial pressure, the amount of molecular hydrogen supplied is typically in a range of about 300 scf/Bbl (53 S $m^3/m^3$) to 1000 scf/Bbl (178 S $m^3/m^3$).

Typically, the pretreatment hydroprocessing in at least one hydroprocessing zone of the pretreatment reactor is carried out in the presence of a catalytically-effective amount of at least one catalyst having activity for hydrocarbon hydroprocessing. For example, a catalytically effective amount hydroprocessing catalyst(s) can be located in at least one catalyst bed, e.g., a bed in zone 415. Additional catalyst beds, e.g., 416, 417, etc., may be connected in series with catalyst bed 415, optionally with intercooling using treat gas from conduit 80 being provided between beds (not shown).

Conventional hydroprocessing catalyst can be utilized for hydroprocessing the tar stream in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Alternatively or in additions, the catalyst can be a bulk multimetallic hydroprocessing catalyst with or without binder. The catalyst can be a bulk trimetallic catalyst comprised of two Group 8 metals, preferably Ni and Co and the one Group 6 metals, preferably Mo. Suitable catalysts are disclosed, e.g., in U.S. Pat. No. 9,777,227.

In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pre-treat catalyst, such as DN3651 and/or DN3551, available from the same source. However, the invention is not limited to only these catalysts.

In certain aspects not shown in FIG. 3, liquid and vapor portions are separated from the pretreater effluent. The vapor portion is upgraded to remove impurities such as sulfur compounds and light paraffinic hydrocarbon, and the upgraded vapor can be re-cycled as treat gas for use in one or more of hydroprocessing reactors 100, 400, and 500. The liquid portion is conducted via line 110 to intermediate hydroprocessing reactor 100 (corresponding to reactor G in FIG. 2). In other aspects, as shown in FIG. 3, the entire pretreater effluent is conducted away from reactor 400 via line 110 for intermediate hydroprocessing of the entire pretreater effluent in reactor 100. Typically, sufficient molecular hydrogen will remain in the pretreatment effluent for the intermediate hydroprocessing of the pretreated tar-fluid mixture in reactor 100.

Representative Intermediate Hydroprocessing Reactor

In certain aspects, intermediate hydroprocessing is carried out in at least one catalytic hydroprocessing zone located in reactor 100, which can have the form of a conventional hydroprocessing reactor. Suitable reactors and process conditions for intermediate hydroprocessing are disclosed in U.S. Patent Application Publication No. 2020/0063046 and P.C.T. Patent Application Publication No. WO2018/11157.

Typically, the intermediate hydroprocessing is carried out in at least one hydroprocessing zone in the presence of a catalytically-effective amount of at least one catalyst having activity for hydrocarbon hydroprocessing. The catalyst can be selected from among the same catalysts specified for use in the pretreatment hydroprocessing. For example, the intermediate hydroprocessing can be carried out in the presence of a catalytically effective amount hydroprocessing catalyst(s) located in at least one catalyst bed, e.g., a bed in zone 115. Additional catalyst beds, e.g., 116, 117, etc., may be connected in series with catalyst bed 115, optionally with intercooling using treat gas from conduit 80 being provided between beds (not shown). The hydroprocessed effluent is conducted away from reactor 100 via line 120. Typically, the Intermediate Hydroprocessing Conditions include $T_I$>400° C., e.g., in the range of from 300° C. to 500° C., such as 350° C. to 430° C., or 350° C. to 420° C., or 360° C. to 420° C., or 360° C. to 410° C.; and a $WHSV_I$ in the range of from 0.3 $hr^{-1}$ to 20 $hr^{-1}$ or 0.3 $hr^{-1}$ to 10 $hr^{-1}$. It is also typical for the Intermediate Hydroprocessing Conditions to include a molecular hydrogen partial pressure during the hydroprocessing ≥2.75 MPa, such as ≥3.5 MPa, e.g., ≥6 MPa, or ≥8 MPa, or ≥9 MPa, or ≥10 MPa, although in certain aspects it is ≤14 MPa, such as ≤13 MPa, or ≤12 MPa. $P_I$ is typically in the range of from 4 MPa to 15.2 MPa, e.g., 6 MPa to 13.1 MPa. Generally, $WHSV_I$ is ≥0.5 $hr^{-1}$, such as ≥1.0 $hr^{-1}$, or alternatively ≤5 $hr^{-1}$, e.g., ≤4 $hr^{-1}$, or ≤3 $hr^{-1}$. The amount of molecular hydrogen supplied to intermediate hydroprocessing stage operating under Intermediate Hydroprocessing Conditions is typically 1000 scf/Bbl (178 S $m^3/m^3$) to 10000 scf/Bbl (1780 S $m^3/m^3$), e.g., to achieve the desired molecular hydrogen partial pressure. For example, the molecular hydrogen can be provided in a range of from 3000 scf/Bbl (534 S $m^3/m^3$) to 5000 scf/Bbl (890 S $m^3/m^3$). Intermediate hydroprocessing conditions can also include a molecular hydrogen consumption rate in the range of 350 scf/Bbl (62 S $m^3/m^3$)) to about 1500 SCF/B (267 S $m^3/m^3$), e.g., in a range of about 1000 scf/Bbl (178 S $m^3/m^3$) to 1500 scf/Bbl (267 S $m^3/m^3$), or about 1600 scf/Bbl (285 S $m^3/m^3$) to 3200 scf/Bbl (570 S $m^3/m^3$).

Referring again to FIG. 3, the hydroprocessor effluent is conducted away from reactor 100 via line 120. When the second and third preheaters (360 and 70) are heat exchangers, the hot hydroprocessor effluent in conduit 120 can be used to preheat the tar/utility fluid and the treat gas respectively by indirect heat transfer. Following this optional cooling, the hydroprocessor effluent is conducted to separation stage 130 for separating total vapor product (e.g., heteroatom vapor, vapor-phase cracked products, unused treat gas, etc.) and a total liquid product ("TLP") from the hydroprocessor effluent or cooled hydroprocessor effluent as the case may be. The total vapor product is conducted via line 200 to upgrading stage 220, which typically comprises, e.g., one or more amine towers. Fresh amine is conducted to stage 220 via line 230, with rich amine conducted away via line 240. Regenerated treat gas is conducted away from stage 220 via line 250, compressed in compressor 260, and conducted via lines 265, 20, and 21 for re-cycle and re-use in the main hydroprocessing reactor 100 and optionally in retreatment hydroprocessing reactor 500.

The TLP from separation stage 130 typically comprises hydroprocessed SCT, e.g., ≥10 wt. % of hydroprocessed SCT, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). Although the TLP is an improved product over the pyrolysis tar feed, and is a useful blendstock "as-is", it is typically beneficial to carry out further processing.

In the aspects illustrated in FIG. 3, TLP from separation stage 130 is conducted via line 270 to a further separation stage 280, e.g., for separating from the TLP one or more of hydroprocessed SCT, additional vapor, and at last one stream ("mid-cut") 310 suitable for use as recycle via lines 56 and/or 320 as utility fluid or a utility fluid component. The overhead stream (e.g., vapor) is conducted away from separation stage 280 via line 290. Typically, the bottoms stream conducted away via line 134 comprises >50 wt. % of hydroprocessed SCT, e.g., ≥75 wt. %, such as ≥90 wt. %, or ≥99 wt. %; and typically accounts for approximately 40 wt. % of the TLP withdrawn from reactor 100, and typically about 67 wt. % of SCT feed.

Optionally, separation stage 280 is adjusted to shift the boiling point distribution of mid-cut 310 to have properties desired for the utility fluid, e.g., (i) a true boiling point distribution having an initial boiling point ≥177° C. (350° F.) and a final boiling point ≤566° C. (1050° F.) and/or (ii) an $S_{BN}$≥100, e.g., ≥120, such as ≥125, or ≥130. Typically, the mid-cut 310 is at least 10 wt. % of the utility fluid, e.g., ≥25 wt. %, such as ≥50 wt. %. Typically 70 wt. % to 85 wt. % of the mid-cut is recycled to the process, e.g., as at least a portion of the utility fluid. The amount of recycled mid-cut in the tar-fluid mixture is typically 40 wt. %, based on the weight of the tar-fluid mixture, but can range, e.g., from 20 wt. % to 50 wt. %, or from 30 wt. % to 45 wt. %.

In certain aspects the specified hydrocarbon-containing fluid is utilized instead of the utility fluid at various times and locations in the process, e.g., by introducing the specified hydrocarbon-containing fluid into the process via one or more of lines 56 and/or 330; at other locations (not shown) such as into lines 65, 380, 700, 706, 708, and 270; and/or into towers 130 and/or 280, e.g., as reflux. By introducing the specified hydrocarbon-containing fluid at one or more of these locations, most or even all of the tar-fluid mixture can be produced using the specified hydrocarbon-containing fluid. Although the specified hydrocarbon-containing fluid can be introduced at one or more of the indicated locations at start-up, e.g., as a primer fluid, that is not the only time it is advantageous to do so. It has been found to be advantageous to introduce the specified hydrocarbon-containing fluid at one or more of the indicated locations when (i) an appreciable change in SCT feed is made, i.e., a change in SCT feed that would result in an unfavorable changes in the steady-state utility fluid composition, e.g., a decrease in utility fluid aromatics content; and/or (ii) when it is desirable to divert steady-state utility fluid to more efficient or higher-value uses, e.g., for distillate blending and/or sales. It has been discovered that at least in part as a result of its degradation resistance, using the specified hydrocarbon-containing fluid as a primer fluid (as a substitute for at least a portion of conventional supplemental utility fluid) decreases the amount of time for the mid-cut fraction to achieve the desired steady state composition for the mid-cut fraction, i.e., to achieve a composition corresponding to the desired utility fluid. In other words, using the specified hydrocarbon-containing fluid results in the rapid equilibration of a mid-cut comprising, consisting essentially of, or consisting of ≥1.0 wt. % of 1.0 ring class compounds, ≥5.0 wt. % of 1.5 ring class compounds, ≥5.0 wt. % of 2.0 ring class compounds, and ≤0.1 wt. % of 5.0 ring class compounds, where the weight percents are based on the weight of the mid-cut. When the specified hydrocarbon-containing fluid substitutes for more than 50% of the tar-fluid mixture's utility fluid (wt. basis), the mid-cut rapidly equilibrates to have an $S_{BN}$≥90, such as ≥100, e.g., ≥110, and comprise ≥5.0 wt. % of 1.0 ring class compounds, ≥15.0 wt. % of 1.5 ring class compounds, ≥10.0 wt. % of 2.0 ring class compounds, and ≤0.1 wt. % of 5.0 ring class compounds, where the weight percents are based on the weight of the mid-cut, and typically ≥5.0 wt. % of 1.0 ring class compounds, ≥35.0 wt. % of 1.5 ring class compounds, ≥20.0 wt. % of 2.0 ring class compounds, and ≤0.1 wt. % of 5.0 ring class compounds, where the weight percents are based on the weight of the mid-cut.

The overhead 290 and bottoms 134 may be carried away for further processing. If desired, at least a portion of the bottoms can be utilized within the process and/or conducted away for storage or further processing. The bottoms can be desirable as a diluent (e.g., a flux) for heavy hydrocarbons, especially those of relatively high viscosity. In this regard, the bottoms can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. Optionally, trim molecules may be separated, for example, in a fractionator, from bottoms or overhead or both and added to the mid-cut as desired.

When it is desired to further improve properties of the hydroprocessed SCT, e.g., by removing at least a portion of any sulfur remaining in hydroprocessed SCT, an upgraded SCT can be produced by optional retreatment hydroprocessing. Certain forms of the retreatment hydroprocessing will now be described in more detail with respect to FIG. 3. The retreatment hydroprocessing is not limited to these forms, and this description is not meant to foreclose other forms of retreatment hydroprocessing within the broader scope of the invention.

Representative Retreatment Hydroprocessing

As shown in FIG. 3, hydroprocessed tar (line 134) and treat gas (line 21) are conducted to retreatment reactor 500 (corresponding to reactor L of FIG. 2) via line 510. Typically, the retreatment hydroprocessing in at least one hydroprocessing zone of the intermediate reactor is carried out in the presence of a catalytically-effective amount of at least one catalyst having activity for hydrocarbon hydroprocessing. For example, the retreatment hydroprocessing can be carried out in the presence hydroprocessing catalyst(s) located in at least one catalyst bed 515. Additional catalyst beds, e.g., 516, 517, etc., may be connected in series with catalyst bed 515, optionally with intercooling, e.g., using treat gas from conduit 20, being provided between beds (not shown). The catalyst can be selected from among the same catalysts specified for use in the pretreatment hydroprocessing. A retreater effluent comprising upgraded SCT is conducted away from reactor 500 via line 135. Although the retreatment hydroprocessing can be carried out in the presence of the utility fluid, it is typical that it be carried out with little or no utility fluid to avoid undesirable utility fluid hydrogenation and cracking under retreatment hydroprocessing conditions, which are typically more severe than the intermediate hydroprocessing conditions.

Retreatment hydroprocessing conditions typically include $T_R \geq 370°$ C.; e.g., in the range of from 370° C. to 415° C.; $WHSV_R \leq 0.5\ hr^{-1}$, e.g., in the range of from 0.2 $hr^{-1}$ to 0.5 $hr^{-1}$; a molecular hydrogen supply rate ≥3000 SCF/B, e.g., in the range of from 3000 scf/Bbl (534 S $m^3/m^3$) to 6000 scf/Bbl (1068 S $m^3/m^3$); and a total pressure ("$P_R$")≥6 MPa, e.g., in the range of from 6 MPa to 13.1 MPa. Optionally, $T_R > T_I$ and/or $WHSV_R < WHSV_I$.

The upgraded SCT typically has a sulfur content ≤0.3 wt. %, e.g., ≤0.2 wt. %. Other properties of the upgraded SCT include a hydrogen: carbon molar ratio ≥1.0, e.g., ≥1.05, such as ≥1.10, or ≥1.055; an $S_{BN} \geq 185$, such as ≥190, or ≥195; an $I_N \leq 105$, e.g., ≤100, such as ≤95; a 15° C. density ≤1.1 g/$cm^3$, e.g., ≤1.09 g/$cm^3$, such as ≤1.08 g/$cm^3$, or ≤1.07 g/$cm^3$; a flash point ≥, or ≤−35° C. Generally, the upgraded SCT has 50° C. kinematic viscosity that is less than that of the hydroprocessed SCT, and is typically ≤1000 cSt, e.g., ≤900 cSt, such as ≤800 cSt. The retreating generally results in a significant improvement in in one or more of viscosity, solvent blend number, insolubility number, and density over that of the hydroprocessed tar fed to the retreater. Desirably, since the retreating can be carried out without utility fluid, these benefits can be obtained without utility fluid hydrogenation or cracking.

EXAMPLES

Table 1 shows examples of two conventional fluids (first and last column) and several candidates for use as the hydrocarbon-containing fluid. The first column of Table 1 corresponds to an example of a mid-cut portion (150° C.-400° C.) of the effluent from the specified pyrolysis tar hydroprocessing. This is believed to be representative of the type of recycle portion that could be used as a utility fluid during steady state operation of solvent-assisted hydroprocessing of SCT. The second column corresponds to an example of a second stage bottoms fraction from a catalytic reforming process. The third column corresponds to an example of a third stage bottoms fraction from a catalytic reforming process. The fourth column corresponds to a fourth stage bottoms fraction from a catalytic reforming process. All of the bottoms fractions in Table 1 correspond to bottoms fractions where Cs aromatics and lower boiling compounds have been removed. The second stage bottoms and third stage bottoms were generated from a configuration similar to the configuration shown in FIG. 1, so the difference between the second stage bottoms and third stage bottoms corresponds to a difference in the content of $C_9$-$C_{11}$ aromatics in the two bottoms fractions. The fourth stage bottoms fraction is generated from a different type of configuration, and therefore does not have any necessary relationship to the composition of the other bottoms fractions. The final column corresponds to an example of an Aromatic 200 aromatic fluid available from ExxonMobil Chemical. The Aromatic 200 fluid is noted as an example of a conventional supplemental utility fluid that is rich in single-ring aromatics, and that has been identified as a primer fluid in U.S. Pat. No. 9,777,227.

The properties described in Table 1 include sulfur in wt. %; hydrogen in wt. %; $S_{BN}$; API gravity in degrees; density at 15° C. in g/$cm^3$; and bromine number.

TABLE 1

Utility Fluid Properties

| Property | Recycled Mid-Cut Effluent | Second Stage Bottoms | Third Stage Bottoms | Fourth Stage Bottoms | Aromatic 200 |
|---|---|---|---|---|---|
| Sulfur (wt. %) | 0.097 | 0.012 | 0.006 | 0.0048 | 0.006 |
| Hydrogen (wt. %) | 9.9 | 9.528 | 9.3 | 8.267 | 8.196 |
| SBN | 125 | 126 | 128 | 135 | 146 |
| API | 13.6 | 20.78 | 16.7 | 11.65 | 10.5 |
| Density | 0.9743 | 0.9284 | 0.9539 | 0.9876 | 0.9956 |
| Bromine number | 1.9 | 1.6 | 1.8 | 2.7 | 1.3 |

As shown in Table 1, all of the catalytic reforming bottoms fractions have at least some properties that indicate suitability for use as the hydrocarbon-containing fluid as a substitute for mid-cut in certain circumstances (e.g., as a primer fluid or when sufficient mid-cut is not available during a change in tar feed composition and/or a change in tar hydroprocessing conditions). Because the bottoms fractions are from a catalytic reforming process, all of the bottoms fractions have sulfur contents of less than 0.015 wt. % (less than 150 wppm). This is substantially lower than the roughly 0.1 wt. % sulfur content of the mid-cut fraction of the hydroprocessed effluent, e.g., that of Reactor G of FIG. 2. The bottoms fractions also have an $S_{BN}$ similar to or higher than 125, which corresponds to a desired $S_{BN}$ for the indicated mid-cut fraction. The second stage bottoms and third stage bottoms also have densities that are less than the density of the indicated mid-cut fraction, potentially resulting from a lesser content of aromatic hydrocarbon in the bottoms fraction than is present in the mid-cut fraction. It is noted that the fourth stage bottoms fraction has a higher density than the mid-cut fraction, although it is still less than the density of the Aromatic 200 fluid. Finally, all of the fractions shown in Table 1 have a bromine number <5, indicating a low olefin content.

Without being bound by any particular theory, it is believed that the low sulfur of the catalytic reforming bottoms fractions can have an additional benefit when used as the hydrocarbon-containing fluid. Since the catalytic reforming bottoms fractions have a lesser low sulfur content, a more selective hydrodesulfurization can be performed on sulfur-containing compositions having a normal boiling point within the normal boiling point range of pyrolysis tar. Carrying out a more selective hydrodesulfurization (especially in reactor G of FIG. 2) on both utility fluid and tar can decrease or minimize both (i) molecular hydrogen consumption during pyrolysis tar hydroprocessing and (ii) utility fluid conversion to compounds of lesser normal boiling point and/or increased aromatic saturation.

Figure 4:
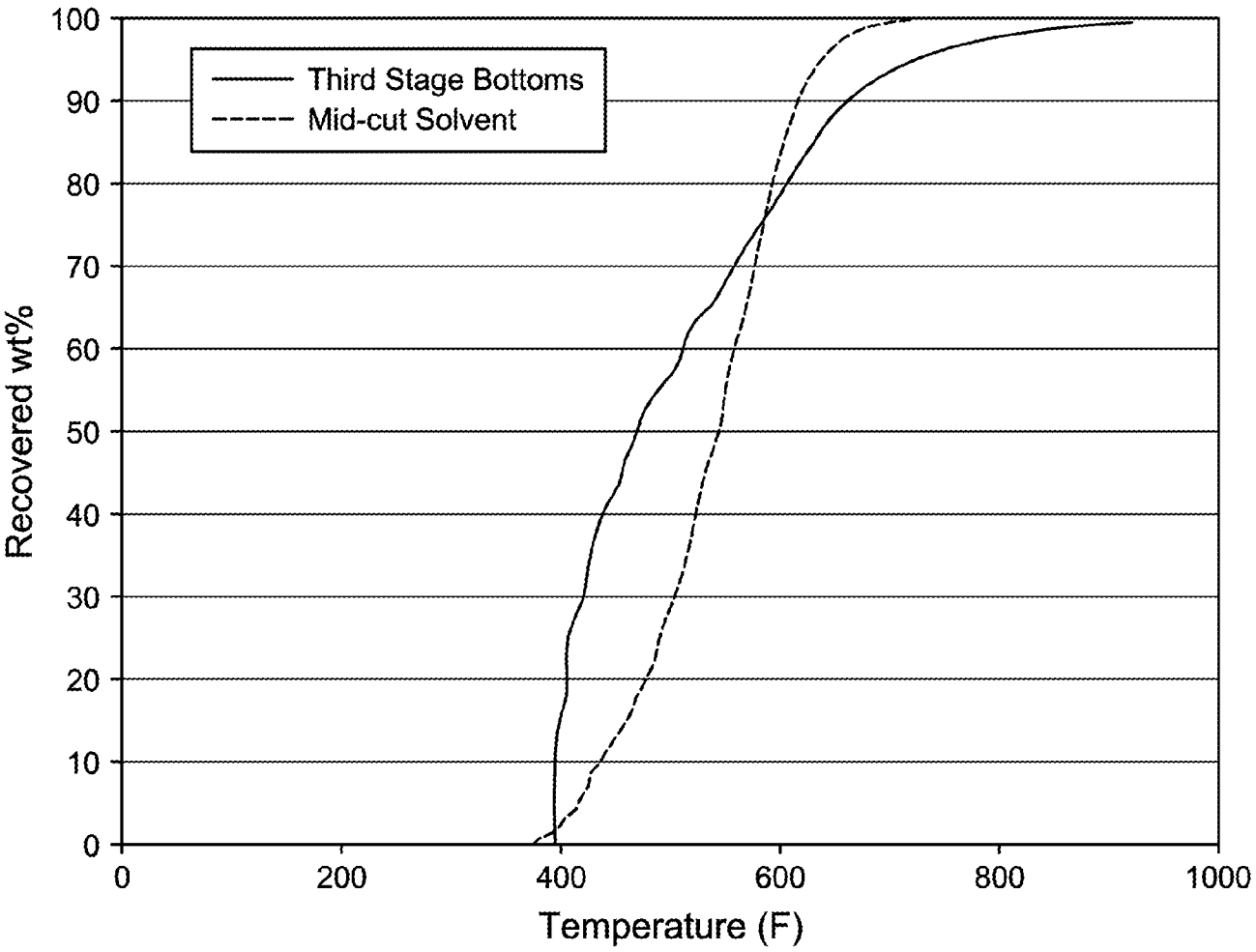
FIG. 4 shows boiling range profiles for utility fluids.

FIG. 4 shows a comparison of the boiling point profile for the third stage bottoms fraction and the mid-cut fraction of the hydroprocessor effluent (at steady state). As shown in FIG. 4, the third bottoms fraction includes less than 5.0 wt. % of compounds that boil above 400° C. This is in contrast to the mid-cut fraction of the hydroprocessor effluent, which contains substantially no compounds that boil above 400° C. As shown in FIG. 4, although there are differences in the two boiling point profiles, less than 5.0 wt. % of the compounds in the third bottoms fraction boil outside of the boiling range for the mid-cut fraction of the hydroprocessor effluent.

To further investigate the suitability of a catalytic reforming bottoms fraction for use as the hydrocarbon-containing fluid, the third stage bottoms fraction (from Table 1 and FIG. 4) is used as a primer fluid for initiating pyrolysis tar hydroprocessing in a pilot scale reaction system. The pilot scale system included a pre-treatment stage (reactor F of FIG. 2), a first hydroprocessing stage (reactor G of FIG. 2), and a second hydroprocessing stage (reactor L of FIG. 2). The tar—fluid mixture initially corresponded to a mixture of 60 vol. % pyrolysis tar and 40 vol. % of the specified hydrocarbon-containing fluid. After sufficient tar—fluid mixture passes into the reaction system to form the pyrolysis effluent, a recycled mid-cut portion (portion J of FIG. 2) effluent from reactor G is used as the utility fluid in the 60/40 volume ratio.

During hydroprocessing, the hydrogen partial pressure in the system is maintained at 1200 psig (~8.3 MPa-g). The catalyst used for hydroprocessing is a commercially available Co—Mo hydrodesulfurization catalyst. The space velocity within the stages is roughly 0.8 $hr^{-1}$, with some variation depending on the exact amount of catalyst load in each stage. The hydrogen flow in the reaction system is 3000 scf/Bbl (~500 $Nm^3/m^3$). The hydrogen is delivered to the three stages so that 25 vol. % is added to the feed prior to the pre-treatment stage, 40 vol. % is added prior to the first hydroprocessing stage, and 35 vol. % is added prior to the second hydroprocessing stage. The temperature in the pre-treatment stage is roughly 260° C. The temperature in the first hydroprocessing stage is roughly 360° C. The temperature in the second hydroprocessing stage is roughly 375° C.-390° C. The processing run is continued for 90 days in order to characterize performance over an extended time period.

Figure 5:
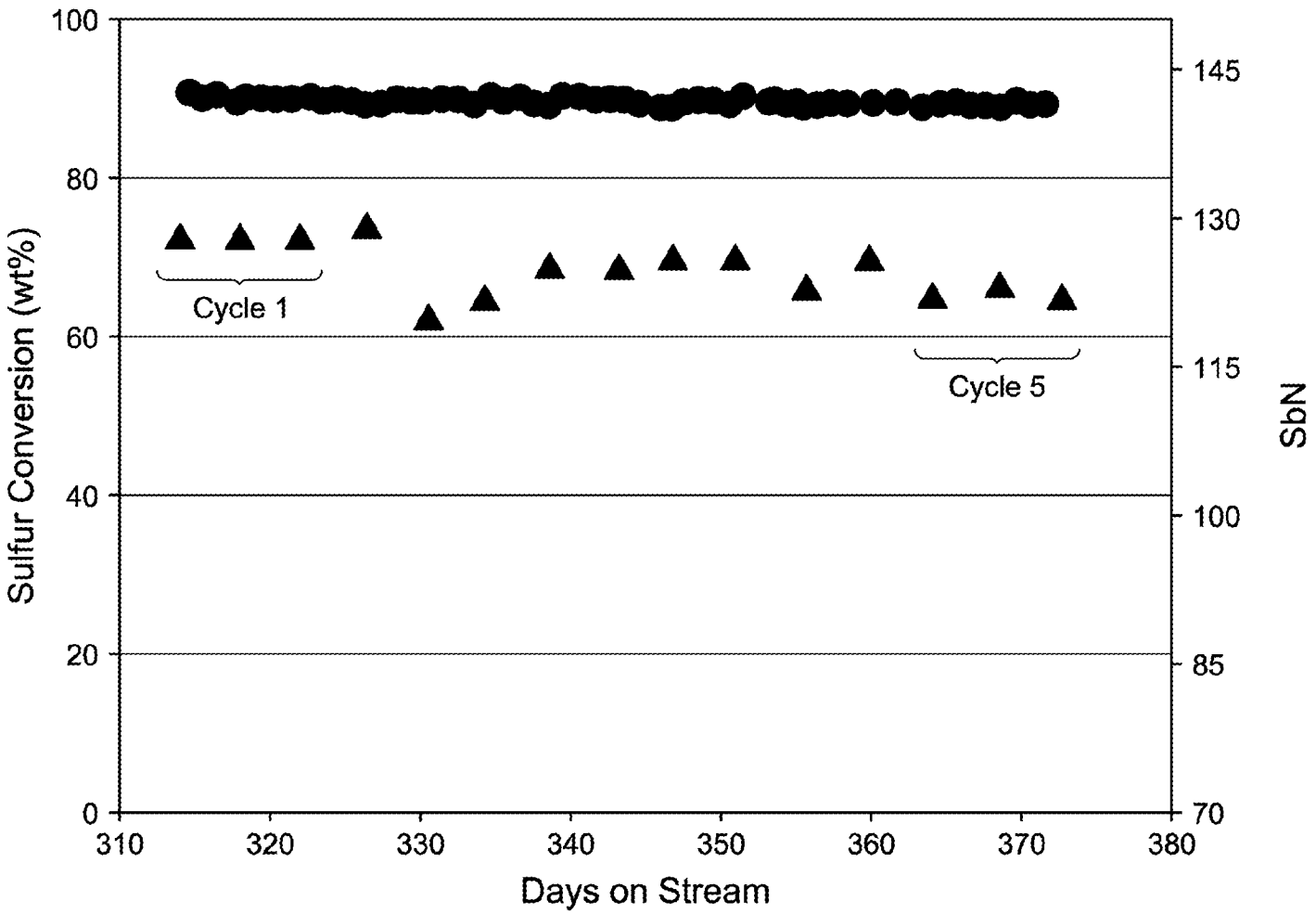
FIG. 5 shows results from a start-up time period for solvent-assisted hydroprocessing of pyrolysis tar.

FIG. 5 shows results from solvent-assisted hydroprocessing of a pyrolysis tar, using the third bottoms fraction as the hydrocarbon-containing fluid for start-up of the process (e.g., as a primer fluid). The left axis corresponds to the level of sulfur removal from the pyrolysis tar, while the right axis corresponds to the $S_{BN}$ of the mid-cut fraction (150° C.-400° C.). As shown, the sulfur removal is near 90 wt. % removal over the course of the entire run. This indicates that the process is stable and therefore that the hydrocarbon-containing fluid successful facilitated process start-up until a suitable utility fluid is created (the mid-cut). It is noted that the pressure drop across the pre-treatment stage had little or no change during the course of the processing run. This also indicates stable operation, as the pre-treater would be expected to quickly develop a pressure drop if a suitable utility fluid is not used. The stable operation is consistent with the high values for $S_{BN}$ for the mid-cut fraction during the course of the process. At all times during the process, the $S_{BN}$ for the mid-cut fraction remained above 115.

The effluent from the second hydroprocessing stage is sampled periodically to allow for characterization of the mid-cut. Table 2 shows mid-cut quantitative characterization using 2-dimensional gas chromatography for four types of utility fluid based on ring class. The first column corresponds to the third stage bottoms fraction that is used initially as the initial hydrocarbon-containing fluid (as primer fluid). The second column corresponds to the mid-cut fraction of the pyrolysis effluent during the "1$^{st}$ cycle", which corresponded to roughly days 15 to 25 of the processing run. This second column represents the state of the utility fluid shortly after a sufficient amount of mid-cut fraction is available to form the utility fluid from the recycle stream without adding more of the specified hydrocarbon-containing fluid. Thus, the second column represents the state of the recycle stream after some exposure of the initial hydrocarbon-containing fluid to the hydroprocessing conditions, but while the system is still relatively far from the steady state composition. The third column corresponds to the mid-cut fraction during the "6$^{th}$ cycle", which corresponds to roughly days 75 to 85. At this point, the composition of the mid-cut fraction is starting to approach the steady state composition. The fourth column shows the steady state composition from conversion of pyrolysis tar in a separate solvent-assisted hydroprocessing reaction system.

TABLE 2

Characterization of Utility Fluids

| Name/ID<br>SBN | Third Stage Bottoms Fraction<br>128 | 1$^{st}$ Cycle solvent<br>122 | 6$^{th}$ Cycle solvent<br>126 | Steady State mid-cut (separate process)<br>125 |
|---|---|---|---|---|
| | Wt. % | | | |
| Saturates | 0.02% | 1.27% | 2.25% | 1.96% |
| 1.0-ARO | 7.78% | 5.17% | 6.86% | 7.47% |
| 1.5-ARO | 41.90% | 25.88% | 28.16% | 26.43% |
| 2.0-ARO | 31.29% | 24.75% | 32.85% | 33.61% |
| 2.5-ARO | 13.72% | 34.62% | 24.41% | 24.57% |
| 3.0-ARO | 3.33% | 7.88% | 5.22% | 5.37% |
| 3.5-ARO | 1.42% | 0.41% | 0.26% | 0.59% |
| 3.5+-ARO | 0.54% | 0.02% | 0.00% | 0.00% |
| Total | 100.00% | 100.00% | 100.00% | 100.00% |

As shown in Table 2, the initial hydrocarbon-containing fluid as primer fluid has a relatively high content of compounds (greater than 40 wt. %) with a ring class of 1.5. This indicates a substantial number of compounds including at least one saturated ring. The initial hydrocarbon-containing fluid also includes less than 20 wt. % of compounds with a ring class of 2.5 or more. This is in contrast to the composition of the recycle stream during the first cycle, as shown in the second column. During the first cycle (roughly days 15 to 25), the composition of the recycle stream is significantly shifted toward higher ring classes, with more than 40 wt. % of the recycle stream corresponding to a ring class of 2.5 or more. However, in spite of the heavier nature of the converted SCT compounds in the mid-cut fraction during the start-up period (e.g., when adding the hydrocarbon-containing fluid), the content of compounds with a ring class of 1.5 is relatively close to the final value. Without being bound by any particular theory, this is believed to represent the stability of the hydrocarbon-containing fluid as primer fluid after repeated exposure to the hydroprocessing conditions. It is further believed that the high initial content of compounds with a ring class of 1.5 and 2.0 in the initial supplemental utility fluid contributes to maintaining relatively large $S_{BN}$ throughout the run. By starting with a greater content of compounds with a ring class of 1.5 and 2.0, the quantity of compounds in these ring classes can be maintained until the recycle stream composition approaches steady state.

The non-steady state nature of the utility fluid after the first cycle can also be seen in the relatively low content of saturates and 1.0 ring class compounds. The steady-state recycle stream in the fourth column includes roughly 2 wt. % saturates and roughly 7 wt. % of compounds with a ring class of 1.0. During the first cycle, the saturates content in the recycle stream is closer to 1 wt. %, while the content of compounds with a 1.0 ring class is closer to 5 wt. %. It is noted that the differences between the composition after the first cycle and the mid-cut solvent did not appear to have an adverse effect on sulfur conversion or solubility.

By the sixth cycle, Table 2 shows that the recycle stream in the third column is approaching the composition of the steady state recycle stream in the fourth column. It is noted that the steady state recycle stream in the fourth column is formed from a different pyrolysis tar source, so some differences in composition between the third and fourth column would be expected. However, the overall ring class profile between the third column and the fourth column is similar.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A pyrolysis tar processing method, comprising:

mixing a tar feed with a utility fluid to produce a tar-fluid mixture, wherein the tar feed includes at least one tar, the utility fluid has a solubility blending number of 90 or more, a density of 0.98 g/cm$^3$ or less, and a bromine number of less than 5, and the utility fluid comprises 30 wt. % or more of compounds with a ring class of 1.5 and 20 wt. % or less of compounds with a ring class of 1.0 or less; and hydroprocessing the tar-fluid mixture under solvent-assisted hydroprocessing conditions to form a hydroprocessed effluent, the hydroprocessed effluent comprising a mid-cut fraction having a solubility blending number of 90 or more, an initial boiling point of 150° C. or more, and a final boiling point of 400° C. or less.

2. The method of claim 1, wherein the tar is a steam cracker tar, and the utility fluid comprises a density of 0.96 g/cm$^3$ or less.

3. The method of claim 1, wherein the utility fluid comprises 25 wt. % or less of compounds having a ring class of 2.5 or more.

4. The method of claim 1, wherein the utility fluid comprises a solubility blending number of 110 or more.

5. The method of claim 1, wherein the utility fluid comprises 5.0 wt. % or less of aliphatic compounds.

6. The method of claim 1, wherein the tar-fluid mixture comprises 40 wt. % to 90 wt. % pyrolysis tar and 10 wt. % to 60 wt. % utility fluid, relative to a weight of the tar-fluid mixture.

7. The method of claim 1, wherein the tar-fluid mixture has a tar feed to utility fluid weight ratio of 1.0 or more.

8. The method of claim 1, further comprising:

separating a recycle fraction comprising the mid-cut fraction from the hydroprocessed effluent;

mixing the recycle fraction with a second portion of the tar feed; and hydroprocessing the mixture of the second portion of the tar feed and the recycle fraction under the solvent-assisted hydroprocessing conditions to form a second hydroprocessed effluent, the second hydroprocessed effluent comprising a second mid-cut fraction having a solubility blending number of 90 or more, an initial boiling point of 150° C. or more, and a final boiling point of 400° C. or less.

9. The method of claim 8, wherein a density of the recycle fraction is greater than the density of the utility fluid.

10. The method of claim 8, wherein the recycle fraction comprises 30 wt. % or less of compounds having a ring class of 1.5.

11. The method of claim 8, wherein the recycle fraction comprises a solubility blending number of 110 or more.

12. The method of claim 8, wherein the recycle fraction comprises 5.0 wt. % or less of aliphatic compounds.

13. The method of claim 8, wherein the mixture of the second portion of the tar feed and the recycle fraction comprises 40 wt. % to 90 wt. % of SCT tar and 10 wt. % to 60 wt. % of the second recycle fraction, relative to a weight of the mixture.

14. The method of claim 8, wherein the mixture of the second portion feedstock and the recycle fraction comprises a weight ratio of pyrolysis tar to second recycle fraction of 1.0 or more.

15. The method of claim 1, wherein the utility fluid comprises a bottoms fraction from a catalytic reforming process.

16. A hydroprocessing method, comprising:

mixing a pyrolysis tar feed with a utility fluid to produce a tar-fluid mixture, wherein the utility fluid has a solubility blending number of 90 or more, a density of 0.98 g/cm$^3$ or less, and a bromine number of less than 5, and the utility fluid comprises 30 wt. % or more of compounds with a ring class of 1.5, 20 wt. % or less of compounds with a ring class of 1.0 or less, and 5.0 wt. % or less of aliphatic compounds;

hydroprocessing the tar-fluid mixture under solvent-assisted hydroprocessing conditions to form a hydroprocessed effluent, the hydroprocessed effluent comprising a mid-cut fraction having a solubility blending number of 90 or more, an initial boiling point of 150° C. or more, and a final boiling point of 400° C. or less;

separating a recycle fraction comprising the mid-cut fraction from the hydroprocessed effluent to form, the recycle fraction having a density greater than that of the utility fluid;

mixing the recycle fraction with a second portion of feedstock; and hydroprocessing the mixture of the second portion of feedstock and the recycle fraction under the solvent-assisted hydroprocessing conditions to form a second hydroprocessed effluent, the second hydroprocessed effluent comprising a second mid-cut fraction having a solubility blending number of 90 or more, an initial boiling point of 150° C. or more, and a final boiling point of 400° C. or less.

17. The method of claim 16, wherein the recycle fraction comprises 30 wt. % or less of compounds having a ring class of 1.5.

18. The method of claim 16, wherein the recycle fraction comprises a solubility blending number of 110 or more.

19. The method of claim 16, wherein the recycle fraction comprises 5.0 wt. % or less of aliphatic compounds.

20. The method of claim 16, wherein the mixture of the second portion of feedstock and the recycle fraction comprises 40 wt. % to 90 wt. % pyrolysis tar and 10 wt. % to 60 wt. % of the second recycle fraction, relative to a weight of the mixture.

21. The method of claim 16, wherein the mixture of the second portion feedstock and the recycle fraction comprises a weight ratio of pyrolysis tar to second recycle fraction of 1.0 or more.

22. The method of claim 16, wherein the utility fluid comprises 25 wt. % or less of compounds having a ring class of 2.5 or more.

23. The method of claim 16, wherein the formation of the recycle fraction and the mixing of the recycle fraction with the second portion of feedstock is repeated at least two times.

24. The method of claim 16, wherein the formation of the recycle fraction and the mixing of the recycle fraction with the second portion of feedstock is repeated continuously or semi-continuously.

25. A hydrocarbon upgrading process, comprising (a) providing a naphtha feed (b) reforming the naphtha to produce a reformate (c) separating an aromatics bottoms stream from the reformate, wherein (i) the aromatics bottoms stream comprising >30 wt. % of compounds with a ring class of 1.5 and ≤20 wt. % of compounds with a ring class of 1.0, based on the weight of the aromatics bottoms stream, and (ii) the hydrocarbon-containing fluid has a SBN ≥90, a density≤0.98 g/cm$^3$, and a bromine number <5;

(d) combining the aromatics bottoms stream and a tar feed to produce a tar-fluid mixture;

(e) catalytically hydroprocessing the tar-fluid mixture to form a hydroprocessed effluent, the hydroprocessed effluent comprising a mid-cut fraction having a solubility blending number of 90 or more, an initial boiling point of 150° C. or more, and a final boiling point of 400° C. or less;

(f) separating a recycle fraction comprising the mid-cut fraction from the hydroprocessed effluent to form, the recycle fraction having a density greater than that of the aromatics bottoms stream;

(g) substituting the recycle fraction for at least a portion of the aromatics bottoms stream in step (c) to produce a second tar-fluid mixture; and (h) catalytically hydroprocessing the second tar-fluid mixture to form a second hydroprocessed effluent, the second hydroprocessed effluent comprising a second mid-cut fraction having a solubility blending number of 90 or more, an initial boiling point of 150° C. or more, and a final boiling point of 400° C. or less.

26. The process of claim 25, wherein the aromatics bottoms stream is a primer fluid.

* * * * *